US007392678B2

(12) United States Patent
Niwa et al.

(10) Patent No.: US 7,392,678 B2
(45) Date of Patent: Jul. 1, 2008

(54) BENDING MACHINE

(75) Inventors: Yoshiaki Niwa, Kanagawa (JP); Hidekatsu Ikeda, Kanagawa (JP); Takahiro Shibata, Kanagawa (JP)

(73) Assignee: Amada Company, Limiited, Kanagawa (JP)

( * ) Notice: Subject to any disclaimer, the term of this patent is extended or adjusted under 35 U.S.C. 154(b) by 450 days.

(21) Appl. No.: 10/531,989

(22) PCT Filed: Oct. 23, 2003

(86) PCT No.: PCT/JP03/13550

§ 371 (c)(1),
(2), (4) Date: Jul. 19, 2005

(87) PCT Pub. No.: WO2004/037457

PCT Pub. Date: May 6, 2004

(65) Prior Publication Data

US 2006/0162408 A1 Jul. 27, 2006

(30) Foreign Application Priority Data

Oct. 23, 2002 (JP) ..... 2002-308988
Oct. 17, 2003 (JP) ..... 2003-357269

(51) Int. Cl.
*B21D 5/02* (2006.01)
*B23D 37/14* (2006.01)

(52) U.S. Cl. ..... 72/31.01; 72/31.1; 72/31.12; 700/145; 395/420; 395/660; 356/138

(58) Field of Classification Search ..... 72/31.1, 72/31.12, 31.11, 389.3, 389.6, 419, 420; 700/97, 145; 395/420, 660; 356/138, 375, 356/398

See application file for complete search history.

(56) References Cited

U.S. PATENT DOCUMENTS 5,934,133 A 8/1999 Takahashi et al.
5,969,973 A 10/1999 Bourne et al.
5,983,688 A * 11/1999 Anzai et al. ..... 72/15.1
6,374,658 B1 4/2002 Gascoin et al.
6,480,269 B2 11/2002 Brinkman et al.
6,807,835 B1 * 10/2004 Sekita et al. ..... 72/31.1
2003/0000269 A1 1/2003 Koyama et al.
2003/0010078 A1 1/2003 Koyama et al.

FOREIGN PATENT DOCUMENTS

JP 9-155452 6/1997
JP 9-509618 9/1997
JP 11-221630 8/1999
JP 11-314117 11/1999
JP 2000-254728 9/2000
JP 2001-259743 9/2001

OTHER PUBLICATIONS

English Language Abstract of JP 11-221630.

(Continued)

*Primary Examiner*—David B Jones
(74) *Attorney, Agent, or Firm*—Greenblum & Bernstein, P.L.C.

(57) ABSTRACT

A bending machine has an upper table and a lower table. An input part is provided for inputting product information. A bending order determiner is provided for determining a bending order of the workpiece. A mold determiner is provided for determining the mold necessary for bending the workpiece. A layout determiner is provided for determining layout of the mold. A positioning information calculator is provided for calculating a position of the workpiece with respect to the mold determined by the layout determiner as work position information. A navigation member is provided for navigating a position of the workpiece to the operator by movement in the horizontal direction on the basis of the work position information calculated by the positioning information calculator.

9 Claims, 24 Drawing Sheets

OTHER PUBLICATIONS

English Language Abstract of JP 2001-259743.
English Language Abstract of JP 2000-254728.
English Language Abstract of JP 11-314117.
English Language Abstract of JP 9-155452.

* cited by examiner

BENDING MACHINE

TECHNICAL FIELD

The present invention relates to a bending machine for performing bending of a workpiece in cooperation of an upper bending mold and a lower bending mold, in particular, a bending machine comprising a mechanism for positioning the molds and a mechanism for positioning the workpiece.

BACKGROUND ART

A prior art of conventional bending machines is disclosed in the below-mentioned patent document 1 and this prior art will be described briefly as follows.

That is, the bending machine of the prior art performs bending with respect to a plate-like work by cooperating the upper bending mold and the lower bending mold and uses a pair of side frames that is opposed to each other in right and left sides and connected integrally as bases. The bending machine has an upper table provided on upper parts of the pair of side frames, a lower table provided on lower parts of the pair of side frames so as to be vertically opposed to the upper table and an NC device for controlling bending and the like.

Here, the upper table extends in the horizontal direction and an upper mold attachment part for attaching the upper bending mold thereto is provided on the bottom side of the upper table. The lower table extends in the horizontal direction and can move vertically with respect to the upper table, and a lower mold attachment part for attaching the lower bending mold thereto is provided on the top side of the upper table. The NC device controls various actuators, determines bending molds used for bending (the upper bending mold and the lower bending mold) and bending order (the order of bending when bending of one piece of work is performed plural times) on the basis of product information representing shape of the product and the like, and determines a layout mode of the bending molds in the horizontal direction.

A navigating tape for guiding the operator is stuck to a front face of the lower table or the upper table and the layout mode is represented on the navigating tape. Accordingly, the operator can attach the bending molds to the mold attachment parts (the upper mold attachment part and the lower mold attachment part) of the mold tables (the upper table and the lower table) according to the layout mode while being guided by the navigating tape.

On the other hand, another prior art of conventional bending machines is disclosed in the below-mentioned patent document 2. In this prior art, a back gauge for positioning the workpiece in the longitudinal direction can be moved in the longitudinal direction and in the horizontal direction. Generally, when bending position is determined, the back gauge is moved in the longitudinal direction. However, by transferring the back gauge in the horizontal direction, the back gauge is diverted to a device for positioning the molds in the horizontal direction.

Examples of the conventional arts include Japanese Patent Application Laid-Open No. 11-221630 (hereinafter referred to as "patent document 1") and U.S. Pat. No. 5,969,973 (hereinafter referred to as "patent document 2". Japanese Patent Application National Publication (Laid-Open) No. 9-509618 exists as a corresponding patent application. Priority Ser. No. 08/338,113, Nov. 9, 1994, United States, and Priority Ser. No. 08/386,369, Feb. 9, 1995, United States).

However, since the navigating tape in the patent document 1 is stuck to the front face of either of the tables, every time the layout mode changes, it is necessary to stick another navigating table representing the changed layout mode. For this reason, when plural types of bending is performed while changing the layout mode, a complicated operation (re-sticking of the navigating tape) is added, leading to a problem that operating time for a series of bending becomes longer, thereby to lower operating efficiency.

On the other hand, in the device in the patent document 2, even when positioning of the molds in the horizontal direction is possible, subsequent complicated positioning of the workpiece in the horizontal direction relies on the operator's experience. Accordingly, when the inexperienced operator performs bending, an error in bending is likely to occur.

Especially, when a window (aperture) is formed at an inner side of the workpiece so as to be surrounded and a small protrusion in the window is bent upwards (cut-raising), the position of the workpiece in the horizontal direction with respect to the molds needs to be determined accurately. In the event that this positioning is inaccurate, although the small protrusion in the window (aperture) needs to be bent, the part surrounding the window (aperture) is also bent, leading to an error in bending.

To solve the above-mentioned problem, a first object of the present invention is provide a bending machine capable of positioning the workpiece and the molds in the horizontal direction accurately even by the inexperienced operator.

A second object of the present invention is to provide a bending machine capable of avoiding interference of a work positioning means with the workpiece.

DISCLOSURE OF THE INVENTION

In order to achieve the above-mentioned object, according to a first aspect of the invention, there is provided a bending machine for bending a workpiece by cooperation of an upper bending mold and a lower bending mold which are movable relatively in the vertical direction, comprising: an upper table which has an upper mold attachment part for attaching the upper bending mold on the bottom side thereof and extends in the horizontal direction; a lower table which is formed so as to be opposed to the upper table in the vertical direction, has a lower mold attachment part for attaching the lower bending mold on the top side thereof and extends in the horizontal direction; an input part for inputting product information; a bending order determination part for determining a bending order of the work; a mold determination part for determining the mold necessary for bending the workpiece; a layout determination part for determining layout of the mold; a positioning information calculation part for calculating a position of the workpiece with respect to the mold determined by the layout determination part as work position information; and a navigating member for navigating position of the workpiece to the operator by movement in the horizontal direction on the basis of the work position information calculated by the positioning information calculation part.

According to the above-mentioned invention, since the work position calculated by the positioning information calculation part is represented by the navigating member to the operator, the operator can perform accurate bending. Therefore, error in bending can be reduced, thereby to cut down the costs of the product.

According to a second aspect of the invention, there is provided a bending machine according to the first aspect, wherein the navigating member is formed on a front face of the lower table so as to be movable in the horizontal direction, has a striking face to which an end face of the work can strike from the left or right direction; and the navigating member can be freely ascended in the direction of an upper face of a die after positioning in the horizontal direction.

According to the above-mentioned invention, since the navigating member descends, the workpiece can be positioned in a space above the navigating member. Therefore, even when the workpiece having a flange part is bent, the fringe part and the navigating member do not interfere with each other. As a result, even a wide work can be bent without being restricted by the shape of the workpiece.

According to a third aspect of the invention, there is provided a bending machine according to the second aspect, wherein a locating member is formed at a front end of the navigating member and has a mounting table for maintaining height of the workpiece appropriately when the workpiece is struck against an end face of the locating member.

According to the above-mentioned invention, the holding table maintains height of the workpiece most suitably, the workpiece is struck against the navigating member accurately, thereby to improve accuracy of the product.

According to a fourth aspect of the invention, there is provided a bending machine according to the second aspect, wherein a locating member is rotatably formed at the front end of the navigating member and by rotating the locating member and striking the workpiece against the end face of the locating member, position of the mold can be guided to the operator.

According to the above-mentioned invention, position of the mold as well as the workpiece is guided to the operator, operability is further improved.

According to a fifth aspect of the invention, there is provided a bending machine according to the first aspect, wherein the navigating member is a back gauge provided in the rear side of the lower table so as to be movable in the horizontal direction and the longitudinal direction.

According to the above-mentioned invention, since position of the workpiece is guided to the operator by the existing back gauge, there is not a need for providing another mechanical structure to reduce the manufacturing cost for the machine.

According to a sixth aspect of the invention, there is provided a bending machine according to the first aspect, wherein the navigating member is a light-emitting device for guiding position of the workpiece to the operator by emitting light at an appropriate position.

According to the above-mentioned invention, since position of the workpiece is guided to the operator by the light-emitting device, the fringe part and the navigating member do not interfere with each other. As a result, even a wide work can be bent without being restricted by the shape of the workpiece.

According to a seventh aspect of the invention, there is provided a bending machine according to the first aspect, wherein the navigating member is a belt with a navigating guide part and the navigating guide pail stops at an appropriate position, thereby to guide position of the workpiece to the operator.

According to the above-mentioned invention, position of the mold as well as the workpiece is guided to the operator by the navigating guide part, operability is further improved.

According to an eighth aspect of the invention, there is provided a bending machine for bending a workpiece by cooperation of an upper bending mold and a lower bending mold, comprising: an upper table which has an upper mold attachment part for attaching the upper bending mold on the bottom side thereof and extends in the horizontal direction; a lower table which is formed so as to be opposed to the upper table in the vertical direction, has a lower mold attachment part for attaching the lower bending mold on the top side thereof, extends in the horizontal direction and can be move relatively in the vertical direction with respect to the upper table; a navigating member which is provided on a front face of at least either of the upper table or the lower table so as to be movable in the horizontal direction and guides the operator; a traveling actuator for transferring the navigating member in the horizontal direction; a mold layout determination part for determining mold layout information representing a layout mode of the lower bending mold and the upper bending mold in the horizontal direction on the basis of product information representing shape of the product and the like; and a traveling actuator control means for controlling the traveling actuator so as to locate the navigating member at a position corresponding to a mold attachment reference position in the horizontal direction on the basis of the mold layout information.

Here, the "mold attachment reference position in the horizontal direction" refers a position that serves as a reference (including region) when the bending molds are attached to the mold attachment parts of the tables.

In the bending machine from the eighth aspect, the mold layout information is determined by the layout information determination means on the basis of the product information. Subsequently, the traveling actuator is controlled by the actuator control means so that the navigating member is positioned at a position corresponding to the mold attachment reference position in the horizontal direction on the basis of the mold layout information. Whereby, the operator can attach the bending molds to the mold attachment parts (the upper mold attachment part and the lower mold attachment part) of the tables (the upper table and the lower table) according to the layout mode while being guided by the navigating member.

Following attachment of the bending molds to the tables, the workpiece is positioned in the longitudinal direction and in the horizontal direction with respect to the bending molds. Subsequently, by transferring the lower table in the vertical direction with respect to the upper table, desired bending of the workpiece in cooperation of the upper bending mold and the lower bending mold can be performed.

In other words, the mold layout information is determined by the layout information determination means on the basis of the product information. Subsequently, the traveling actuator is controlled by the actuator control means so that the navigating member is positioned at a position corresponding to the mold attachment reference position in the horizontal direction on the basis of the mold layout information. Whereby, the operator can attach the bending molds to the mold attachment parts (the upper mold attachment part and the lower mold attachment part) of the tables (the upper table and the lower table) according to the layout mode while being guided by the navigating member.

Following attachment of the bending molds to the tables, the workpiece is positioned in the longitudinal direction and in the horizontal direction with respect to the bending molds. Subsequently, by transferring the lower table in the vertical direction with respect to the upper table, desired bending of the workpiece in cooperation of the upper bending mold and the lower bending mold can be performed.

Therefore, since the navigating pin can be located at the position corresponding to the mold attachment reference position in the horizontal direction on the basis of the mold layout information, even when the layout mode is changed, the bending molds can be attached to the mold attachment parts of the tables according to the changed layout mode while being guided by the navigating pin located at the position corresponding the mold attachment reference position in the horizontal direction on the basis of the mold layout information representing the changed layout mode. For this reason, even when plural types of bending is performed while changing the layout mode, a series of bending processes can be efficiently performed in a short time without adding complicated operations.

According to a ninth aspect of the invention, there is provided a bending machine for bending a workpiece by cooperation of an upper bending mold and a lower bending mold, comprising: an upper table which has an upper mold attachment part for attaching the upper bending mold on the bottom side thereof and extends in the horizontal direction; a lower table which is formed so as to be opposed to the upper table in the vertical direction, has a lower mold attachment part for attaching the lower bending mold on the top side thereof, extends in the horizontal direction and can be move relatively in the vertical direction with respect to the upper table; a navigating member which is provided on a front face of at least either of the upper table or the lower table so as to be movable in the horizontal direction and guides the operator; a traveling actuator for transferring the navigating member in the horizontal direction; a mold layout determination part for determining mold layout information representing a layout mode of the lower bending mold and the upper bending mold in the horizontal direction on the basis of product information representing shape of the product and the like; a positioning information calculation means for calculating work positioning information representing a positioning mode of the workpiece with respect to the lower bending mold on the basis of the product information and the mold layout information; and a traveling actuator control means for controlling the traveling actuator so as to locate the navigating member at a position corresponding to a work positioning reference position in the horizontal direction on the basis of the mold layout information.

Here, the "work positioning reference position in the horizontal direction" refers a position that serves as a reference (including region) when the workpiece is positioned in the horizontal direction with respect to the lower bending mold according to the work positioning mode.

In the bending machine from the ninth aspect, the mold layout information is determined by the layout information determination means on the basis of the product information. Next, the work positioning information is calculated by the positioning calculation means on the basis of the product information and the mold layout information. Subsequently, the traveling actuator is controlled by the actuator control means so that the navigating member is positioned at a position corresponding to the work positioning reference position in the horizontal direction on the basis of the work positioning information. Whereby, the operator can position the workpiece in the horizontal direction with respect to the lower bending mold according to the positioning mode while being guided by the navigating member.

Following positioning of the workpiece in the longitudinal direction and in the horizontal direction with respect to the lower bending mold, by transferring the lower table in the vertical direction with respect to the upper table, desired bending of the workpiece in cooperation of the upper bending mold and the lower bending mold can be performed.

In other words, the mold layout information is determined by the layout information determination means on the basis of the product information. Next, the work positioning information is calculated by the positioning calculation means on the basis of the product information and the mold layout information. Subsequently, the traveling actuator is controlled by the actuator control means so that the navigating member is positioned at a position corresponding to the work positioning reference position in the horizontal direction on the basis of the work positioning information. Whereby, the operator can position the workpiece in the horizontal direction with respect to the lower bending mold according to the positioning mode while being guided by the navigating member.

Following positioning of the workpiece in the longitudinal direction and in the horizontal direction with respect to the lower bending mold, by transferring the lower table in the vertical direction with respect to the upper table, desired bending of the workpiece in cooperation of the upper bending mold and the lower bending mold can be performed.

Since the operator can position the workpiece in the horizontal direction with respect to the lower bending molds according to the positioning mode while being guided by the navigating pin located at the position corresponding to the work positioning reference position, operating time for positioning the work becomes shorter, thereby to improve operating efficiency. For the same reason, even when the workpiece has a plurality of bending parts or non-bending parts, positioning of the workpiece in the horizontal direction with respect to the lower bending molds can be performed with a high degree of accuracy, and for example, the plurality of bending parts at the workpiece can be easily bent simultaneously or the bending parts at the workpiece can be easily bent while avoiding interference between the non-bending parts and the bending molds.

According to a tenth aspect of the invention, there is provided a bending machine according to the ninth aspect, wherein the navigating member is formed on a front face of the lower table so as to be movable in the horizontal direction, has a striking face to which an end face of the workpiece can strike from the left or right direction; and the navigating member can be freely ascended in the direction of an upper face of a die after positioning in the horizontal direction.

In the bending machine from the tenth aspect, after the navigating member is located at the position corresponding to the work positioning reference position in the horizontal direction, the navigating member is fixed by the pin fixing device so as not to move in the horizontal direction. Subsequently, the end face of the workpiece is struck against the striking face of the navigating member from right or left direction.

In other words, after the navigating member is located at the position corresponding to the work positioning reference position in the horizontal direction, the navigating member is fixed by the pin fixing device so as not to move in the horizontal direction. Subsequently, the end face of the workpiece is struck against the striking face of the navigating member from right or left direction.

Accordingly since the end face of the workpiece is struck against the striking face of the navigating pin from the right or left direction in the state where the navigating pin is located at the position corresponding to the work positioning reference position in the horizontal direction and then the navigating pin is fixed by the pin fixing means so as not to move in the horizontal direction with respect to the lower table, positioning accuracy of the workpiece with respect to the lower bending mold in the horizontal direction is improved.

Further, according to the present invention, the mold layout information is determined by the layout information determination means on the basis of the product information. Subsequently, the light-emitting device control means controls so that the appropriate number of the navigating light-emitting devices corresponding the mold attachment reference positions in the horizontal direction emit light on the basis of the mold layout information.

Thus, the operator can attach the bending molds to the mold attachment parts (the upper mold attachment part and the lower mold attachment part) of the tables (the upper table and the lower table) according to the layout mode while being guided by light emission by the appropriate number of corresponding navigating light-emitting devices.

Following attachment of the bending molds to the tables, the workpiece is positioned in the longitudinal direction and in the horizontal direction with respect to the bending molds. Subsequently, by transferring the lower table in the vertical direction with respect to the upper table, desired bending of the workpiece in cooperation of the upper bending mold and the lower bending mold can be performed.

Accordingly, since the appropriate number of navigating light-emitting devices corresponding to the mold attachment reference positions in the horizontal direction on the basis of the mold layout information can be made to emit light, even when the layout mode is changed, the bending molds can be attached to the mold attachment parts according to the changed layout mode while being guided by light emission of the appropriate number of corresponding navigating light-emitting devices corresponding to mold attachment reference positions in the horizontal direction on the basis of the mold layout information representing the changed layout mode. For this reason, even when plural types of bending is performed while changing the layout mode, a series of bending processes can be efficiently performed in a short time.

Further, according to the present invention, the mold layout information is determined by the layout information determination means on the basis of the product information. Next, the work positioning information is calculated by the positioning information calculation means on the basis of the product information and the mold layout information. Subsequently, the light-emitting device control means controls so that the appropriate number of the navigating light-emitting devices corresponding the work positioning reference position in the horizontal direction emit light on the basis of the mold layout information. Thus, the operator can perform positioning of the workpiece with respect to the lower bending mold in the horizontal direction according to the positioning mode while being guided by light emission by the appropriate number of corresponding navigating light-emitting devices.

Following positioning of the workpiece in the longitudinal direction and in the horizontal direction with respect to the lower bending mold, by transferring the lower table in the vertical direction with respect to the upper table, desired bending of the workpiece in cooperation of the upper bending mold and the lower bending mold can be performed.

Accordingly, since the operator can position the workpiece in the horizontal direction with respect to the lower bending molds according to the positioning mode while being guided by light emission by the appropriate number of the navigating light-emitting devices corresponding the work positioning reference position in the horizontal direction, operating time for positioning the work becomes shorter, thereby to improve operating efficiency. For the same reason, even when the workpiece has a plurality of bending parts or non-bending parts, positioning of the workpiece in the horizontal direction with respect to the lower bending molds can be performed with a high degree of accuracy, and for example, the plurality of bending parts at the workpiece can be easily bent simultaneously or the bending parts at the workpiece can be easily bent while avoiding interference between the non-bending parts and the bending molds.

Further, the light-emitting device control part controls so that the appropriate number of the navigating light-emitting devices corresponding to a mold interference reference positions in the horizontal direction on the basis of the work positioning information emit light in a special luminous state. Whereby, the operator can position the workpiece with respect to the lower bending mold according to the positioning mode so that the non-bending parts do not enter to the mold interference reference positions in the horizontal direction while being guided by light emission of the appropriate number of corresponding navigating light-emitting devices in a special luminous state.

Accordingly, since the operator can position the workpiece with respect to the lower bending mold according to the positioning mode so that the non-bending parts do not enter to the mold interference reference positions in the horizontal direction while being guided by light emission of the appropriate number of the navigating light-emitting devices corresponding to a mold interference reference positions in the horizontal direction, the effects as stated in claim 2 can be further improved.

The mold layout information is determined by the layout information determination means on the basis of the product information. Subsequently, the traveling actuator is controlled by the actuator control means so that the navigating guide part is positioned at a position corresponding to the mold attachment reference position in the horizontal direction on the basis of the mold layout information. Whereby, the operator can attach the bending molds to the mold attachment parts (the upper mold attachment part and the lower mold attachment part) of the tables (the upper table and the lower table) according to the layout mode while being guided by the navigating guide part.

Following attachment of the bending molds to the tables, the workpiece is positioned in the longitudinal direction and in the horizontal direction with respect to the bending molds. Subsequently, by transferring the lower table in the vertical direction with respect to the upper table, desired bending of the workpiece in cooperation of the upper bending mold and the lower bending mold can be performed.

The mold layout information is determined by the layout information determination means on the basis of the product information. Next, the work positioning information is calculated by the positioning information calculation means on the basis of the product information and the mold layout information. The traveling actuator control part controls the traveling actuator so that the navigating guide part is located at the position corresponding to the work positioning reference position on the basis of the work positioning information. Whereby, the operator can position the workpiece with respect to the lower bending mold in the horizontal direction while being guided by the navigating guide part.

Following positioning of the workpiece with respect to the lower bending mold in the longitudinal direction and in the horizontal direction, by transferring the lower table in the vertical direction with respect to the upper table, desired bending of the workpiece in cooperation of the upper bending mold and the lower bending mold can be performed.

Therefore, since the navigating guide part can be located at the position corresponding to the mold attachment reference position in the horizontal direction on the basis of the mold layout information, even when the layout mode is changed, the bending molds can be attached to the mold attachment parts of the tables according to the changed layout mode while being guided by the navigating guide part located at the position corresponding the mold attachment reference position in the horizontal direction on the basis of the mold layout information representing the changed layout mode. For this reason, even when plural types of bending is performed while changing the layout mode, a series of bending processes can be efficiently performed in a short time without adding complicated operations.

Further, after the navigating member is located at the position corresponding to the work positioning reference position in the horizontal direction, the clamping bar is moved upwards while swinging the plurality of swinging rinks by operation of the clamping actuator.

Accordingly, the navigating member can be fixed so as not to move in the horizontal direction with respect to the lower table by clamping the clamped piece from the vertical direction in cooperation of the clamping bar and the fixing piece.

Therefore, since the operator can position the workpiece in the horizontal direction with respect to the lower bending molds according to the positioning mode while being guided by the navigating guide part, operating time for positioning the work becomes shorter, thereby to improve operating efficiency. For the same reason, even when the workpiece has a plurality of bending parts or non-bending parts, positioning of the workpiece in the horizontal direction with respect to the lower bending molds can be performed with a high degree of accuracy, and for example, the plurality of bending parts at the workpiece can be easily bent simultaneously or the bending parts at the workpiece can be easily bent while avoiding interference between the non-bending parts and the bending molds.

Subsequently, the clamping bar is transferred downwards by operation of the clamping actuator while swinging the plurality of swinging links downwards. This enables releasing the clamping state of the clamped piece and making the navigating member movable in the horizontal direction with respect to the lower table.

Accordingly, since the fixing bar and the clamping bar extend in the horizontal direction and the clamped piece is clamped from the vertical direction in cooperation of the clamping bar and the fixing piece, the pin fixing device can be shortened as much as possible. For this reason, when the workpiece is bent, the part bent previously can be prevented from interfering with the pin fixing device.

BEST MODE FOR CARRYING OUT THE INVENTION

A first embodiment of a bending machine according to the present invention will be described with reference to FIG. 1 to FIG. 5.

Figure 1:
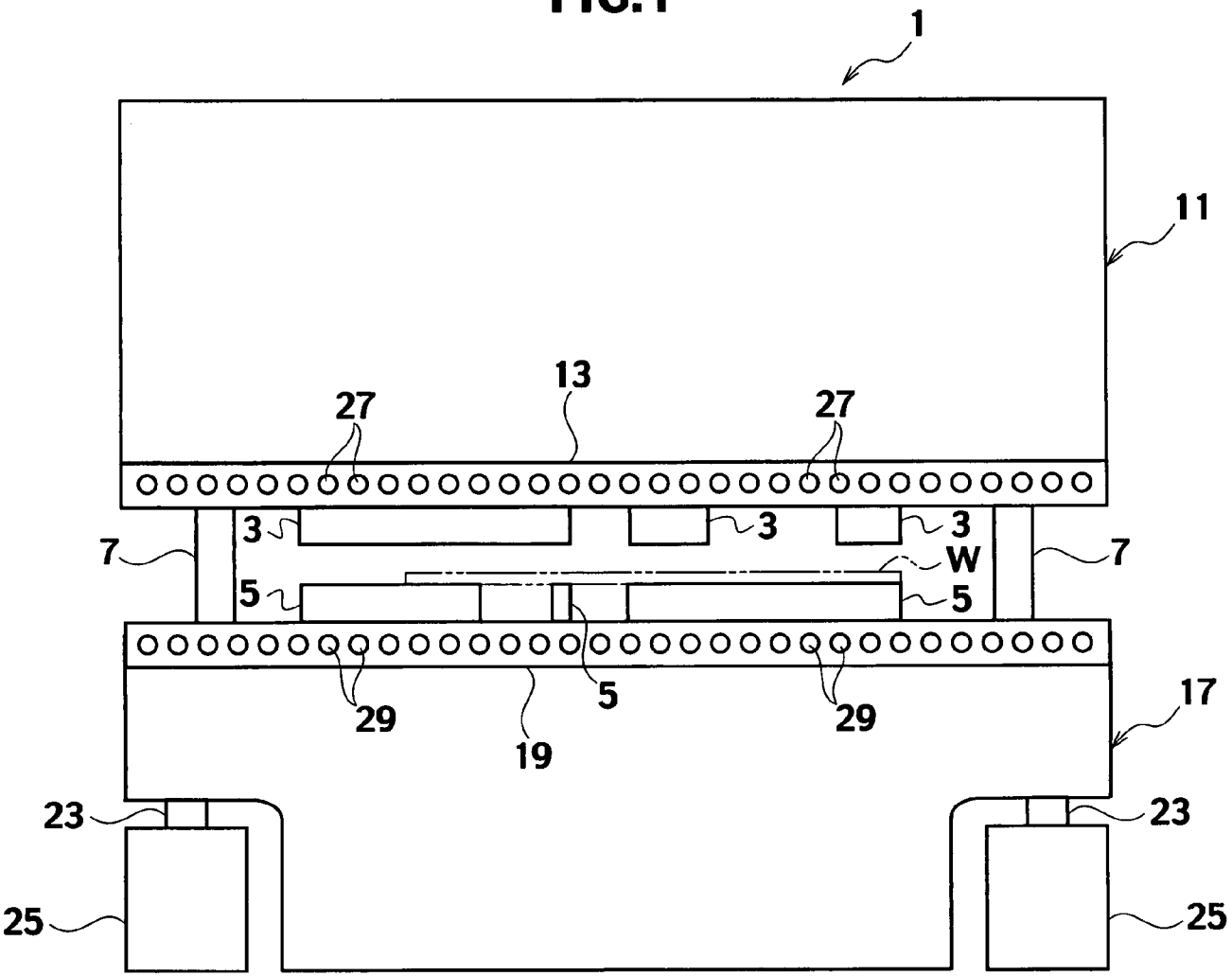
FIG. 1 is a front view of a bending machine in accordance with a first embodiment of the present invention.
Figure 2:
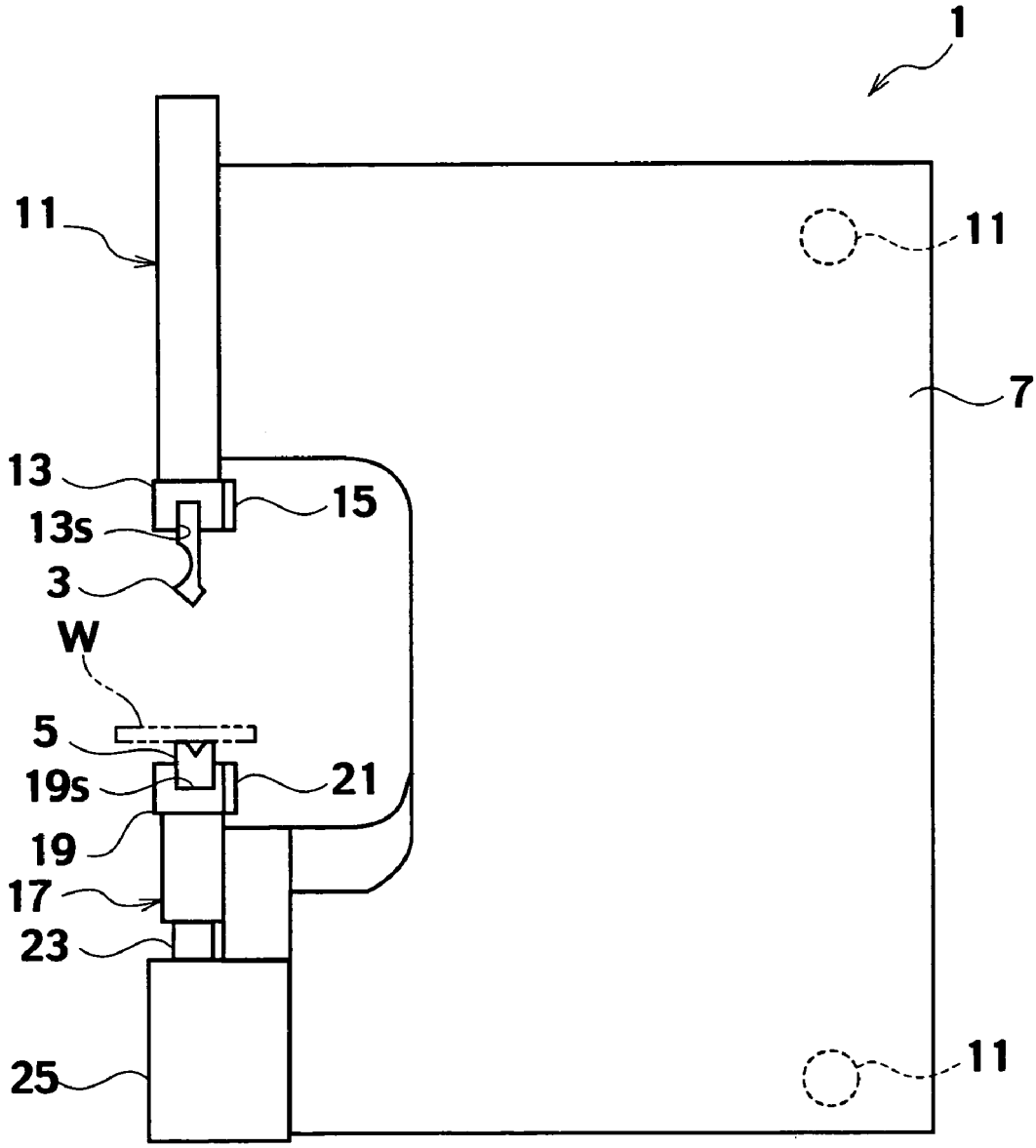
FIG. 2 is a side view of the bending machine in accordance with the first embodiment of the present invention.
Figure 3:
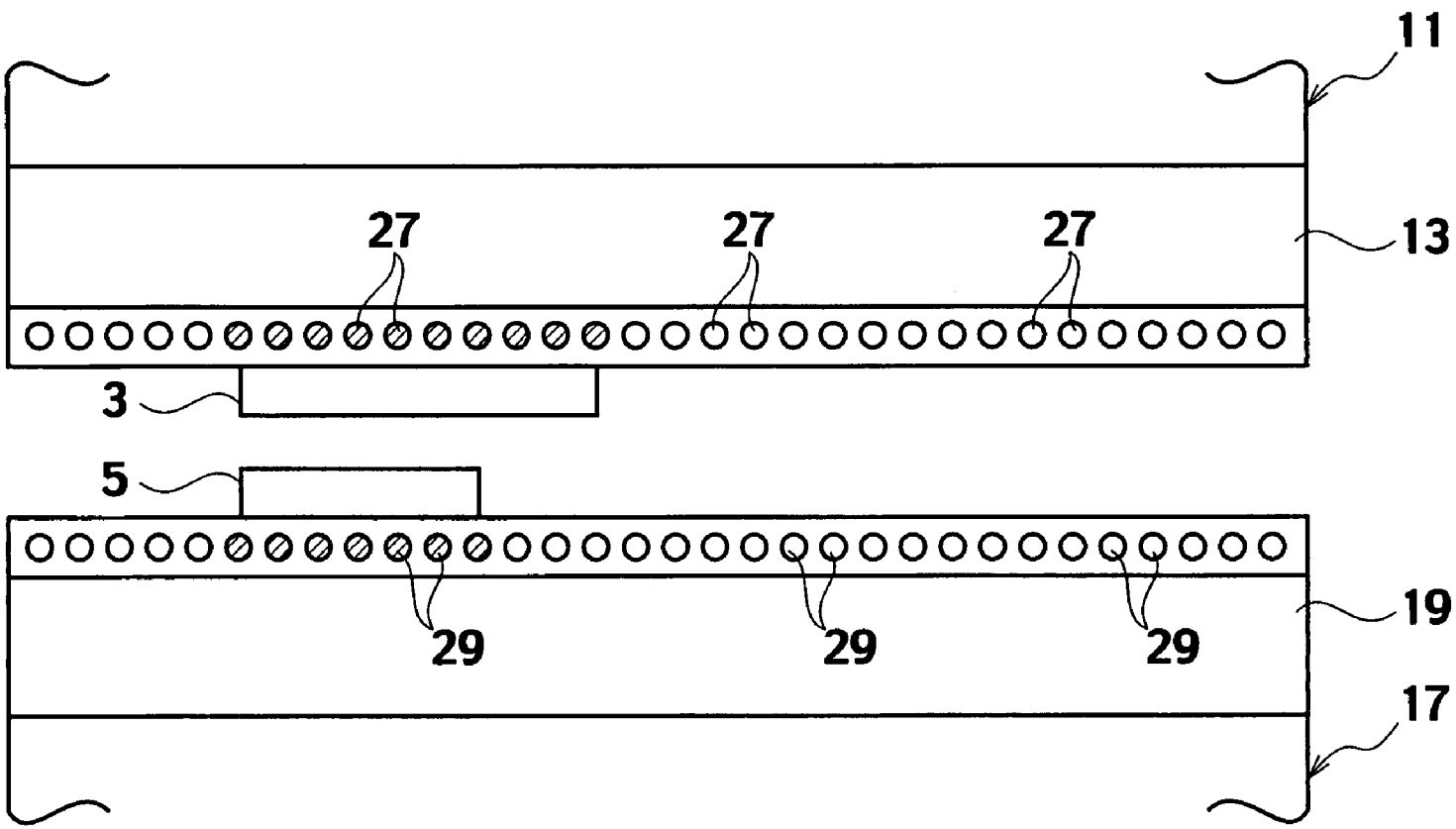
FIG. 3 is a view showing the state where a plurality of upper navigating light-emitting devices and a plurality of lower navigating light-emitting devices that correspond to mold attachment reference positions in the horizontal direction are made to emit light.
Figure 4:
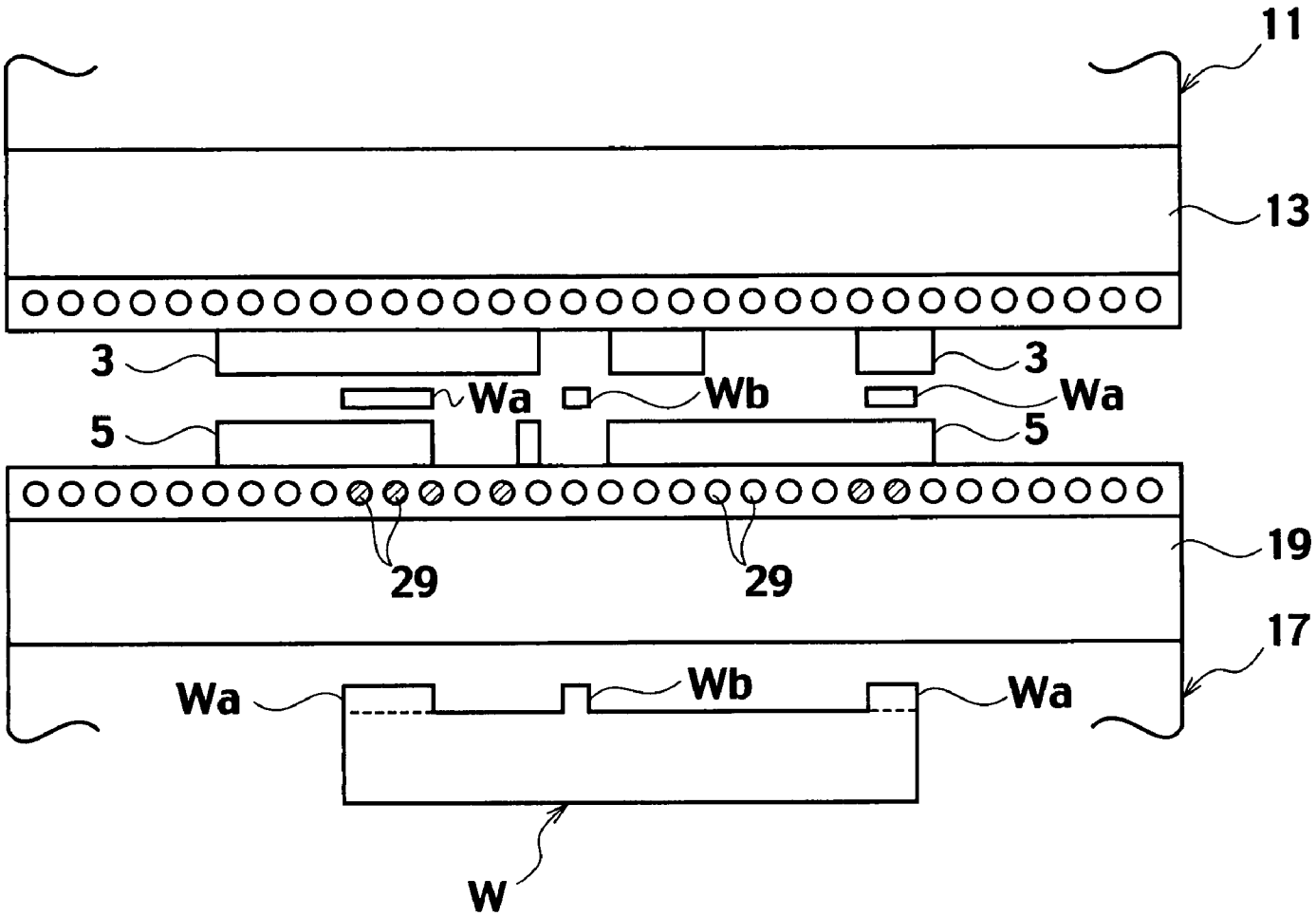
FIG. 4 is a view showing the state where the plurality of lower navigating light-emitting devices corresponding to a work positioning reference position in the horizontal direction are made to emit light.
Figure 5:
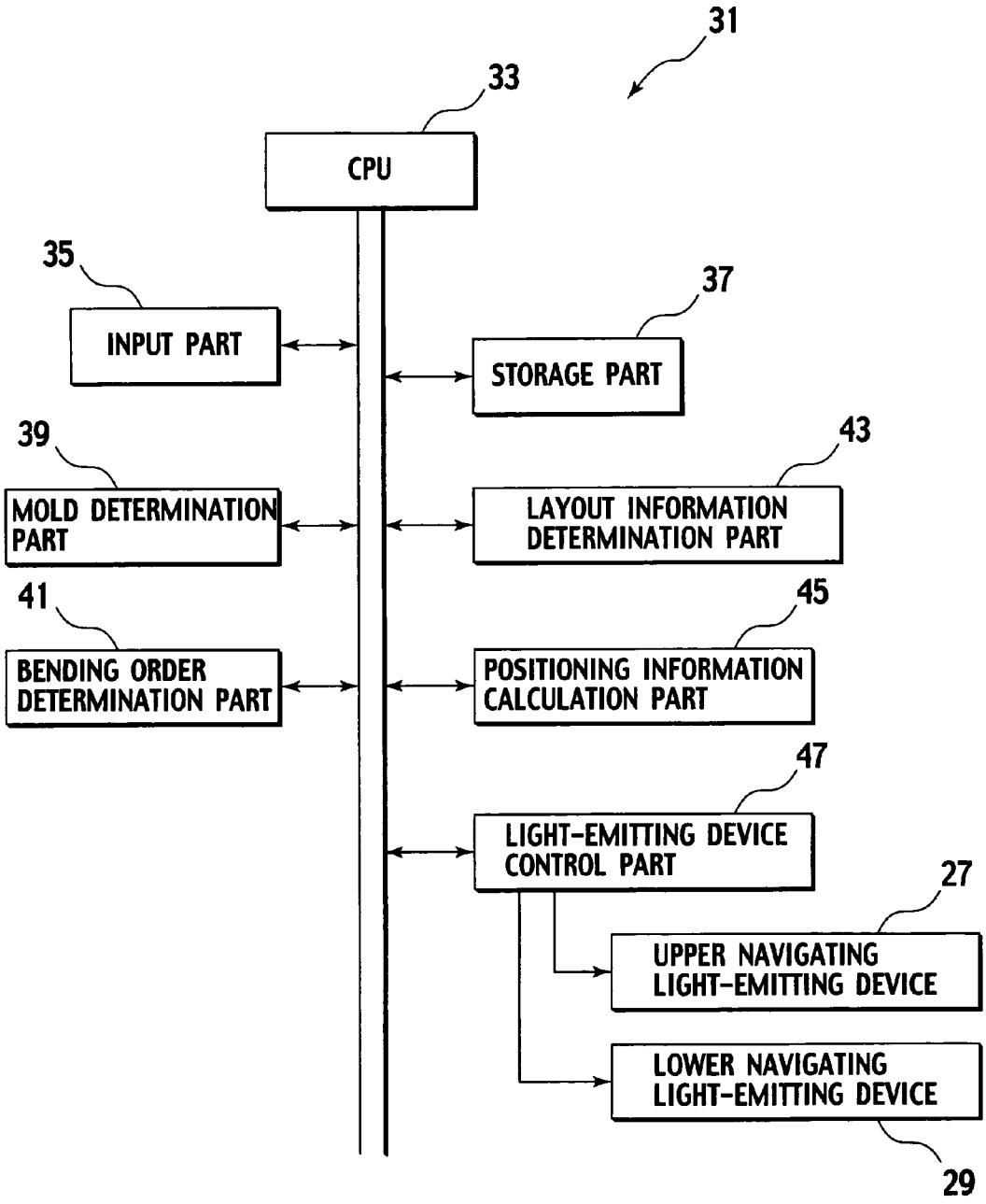
FIG. 5 is a block diagram of an NC device in accordance with the first embodiment of the present invention.

FIG. 1 is a front view of the bending machine in accordance with the first embodiment of the present invention, FIG. 2 is a side view of the bending machine in accordance with the first embodiment of the present invention, FIG. 3 is a view showing the state where a plurality of upper navigating light-emitting devices and a plurality of lower navigating light-emitting devices that correspond to mold attachment reference positions in the horizontal direction emit light, FIG. 4 is a view showing the state where a plurality of upper navigating light-emitting devices and a plurality of lower navigating light-emitting devices that correspond to a work positioning reference position in the horizontal direction emit light and FIG. 5 is a block diagram showing an NC device in accordance with the first embodiment of the present invention.

Here, "horizontal" refers right and left in FIG. 1, FIG. 3 and FIG. 4 and back and front as one faces the sheet in FIG. 2, "longitudinal" refers back and front as one faces the sheet in FIG. 1, FIG. 3 and FIG. 4 and right and left in FIG. 2, and "vertical" refers up and down in FIG. 1 to FIG. 4.

As shown in FIG. 1 and FIG. 2, a bending machine 1 in accordance with the embodiment of the present invention is a machine for performing bending of a plate-like work W by cooperation of an upper bending molds 3 and a lower bending molds 5 and uses a pair of side frames 7 separated right and left as a base. The pair of side frames 7 are connected integrally by a plurality of connecting members 9.

An upper table 11 extending in the horizontal direction is provided on an upper part of the pair of side frames 7, an upper mold holder 13 extending in the horizontal direction is detachably provided on the lower side of the upper table 11, and the upper mold holder 13 has a holding groove 13*s* extending in the horizontal direction for holding the upper bending molds 3. An upper bending mold fixture 15 for fixing the upper bending mold 3 with respect to the upper mold holder 13 so as not to move in the horizontal direction is provided at a rear part of the upper mold holder 13.

A lower table 17 extending in the horizontal direction is provided at a lower part of the pair of side frames so as to be opposed to the upper table in the vertical direction and the lower table 17 is capable of moving in the vertical direction via a guide member (not shown). A lower mold holder 19 extending in the horizontal direction is detachably provided on the upper side of the lower table 17 and the lower mold holder 19 has a holding groove 19*s* extending in the horizontal direction for holding the lower bending molds 5. A lower bending mold fixture 21 for fixing the lower bending mold 5 with respect to the lower mold holder 19 so as not to move in the horizontal direction is provided at a rear part of the lower mold holder 19.

To move the lower table 17 in the vertical direction, a bending cylinder 25 with an operating rod 23 capable of moving in the vertical direction is provided at each of the pair of side frames 7 and the operating rod 23 of each bending cylinder 25 is connected to a proper position of the lower table 17. In the embodiment of the present invention, although the lower table is moved in the vertical direction, the upper table 11 in place of the lower table 17 may be moved in the vertical direction.

Although not shown, a back gauge device for positioning a workpiece W in the longitudinal direction with respect to the lower bending mold is provided in the rear of the lower bending mold 5 and this back gauge device has a striking member against which a rear end face of the workpiece W strikes so as to adjust the position in the longitudinal direction.

As shown in FIG. 3 and FIG. 4, a lot of navigating light-emitting devices 27 for guiding the operator by light emission is provided on a front face of the upper mold holder 13 of the upper table 11 and a lot of navigating light-emitting devices 29 for guiding the operator by light emission is provided on a front face of the lower mold holder 19 of the lower table 17. In the embodiment of the present invention, light-emitting diodes are used as the navigating light-emitting devices 27 and the navigating light-emitting devices 29.

To control guidance by light emission of a lot of the navigating light-emitting devices 27 and navigating light-emitting devices 29, the bending machine 1 has an NC device 31 as shown in FIG. 5 and the NC device 31 has a CPU 33, an input part 35, a storage part 37, a mold determination part 39, a bending order determination part 41, a layout information determination part 43, a positioning information calculation part 45 and a light-emitting device control part 49 as main components and a cylinder control part for controlling the bending cylinder and a back gauge control part for controlling the back gauge device as components not shown.

The input part 35 is electrically connected to the CPU 33 and inputs mechanical information, product information and the like. Here, the "mechanical information" refers information representing mechanical elements of the bending machine 1, including information such as dimensions of predetermined places of the upper table 11 and the lower table 17 and Young's modulus of the upper table 11 and the lower table 17. The "product information" refers information representing shape of the product, including material of the product, thickness of the product, tensile strength of the product, length of bent flange, predetermined bending angle, etc.

The storage part 37 is electrically connected to the CPU 33 and stores various information therein.

The mold determination part 39 is electrically connected to the CPU 33 and determines the bending molds (upper bending mold 3 and the lower bending mold 5) used for bending on the basis of the above-mentioned product information, and the bending order determination part 41 is electrically connected to the CPU 33 and determines the bending order of the workpiece W on the basis of the above-mentioned product information.

The layout information determination part 43 is electrically connected to the CPU 33 and determines mold layout information representing a layout mode of the bending molds 3 and 5 in the horizontal direction on the basis of the bending molds 3, 5 determined by the mold determination part 39, the bending order determined by the bending order determination part 41 (in other words, on the basis of the above-mentioned product information). Here, the "mold layout information" includes information such as offset amount of the center of the bending molds 3 and 5 with respect to the machine center of the bending machine 1.

The positioning information calculation part 43 is electrically connected to the CPU 33 and calculates work positioning information representing a positioning mode of the workpiece W with respect to the lower bending mold 5 on the basis of the bending molds 3, 5 determined by the mold determination part 39, the bending order determined by the bending order determination part 41 and the mold layout information determined by the layout information determination part 43 (in other words, on the basis of the above-mentioned product information and the above-mentioned mold layout information). Here, the "work positioning information" includes information such as offset amount of the center of the workpiece W with respect to the machine center of the bending machine 1.

The layout information determination part 43 determines the mold layout information representing the layout mode of the bending molds 3, 5 in the horizontal direction on the basis of the used bending molds 3, 5 and the bending order, the positioning information calculation part 45 calculates the work positioning information representing the positioning mode of the workpiece W with respect to the lower bending mold 5 on the basis of the used bending molds 3, 5, the bending order and the mold layout information.

Alternatively, a skilled operator may store the bending order, mold selection and mold layout in the storage part 37 through the input part 35 shown in FIG. 5 on the basis of knowledge built up over many years so that the positioning information calculation part 45 calculates the work positioning information representing the positioning mode of the workpiece W with respect to the lower bending mold 5 on the basis of the used bending molds 3, 5, the bending order and the mold layout information. Further, a skilled operator may store the work positioning information representing the positioning mode of the workpiece W with respect to the lower bending mold 5 in the storage part 37 through the input part 35 shown in FIG. 5 on the basis of knowledge built up over many years.

According to the above-mentioned mode, since even inexperienced operator can perform bending on the basis of the knowledge built up by a skilled operator by using the CPU 33, even the unskilled operator can achieve bending with a high degree of accuracy.

The light-emitting device control part 47 is electrically connected to the CPU 33 and specifically, has the following configuration.

That is, the light-emitting device control part 47 is configured controllably so that the plurality of the navigating light-emitting devices corresponding to mold attachment reference positions in the horizontal direction emit light on the basis of the mold layout information among the plurality of the navigating light-emitting devices (the plurality of the upper navigating light-emitting devices 27 and the plurality of the lower navigating light-emitting devices 29) emit light (refer to FIG. 3). Here, the "mold attachment reference position in the horizontal direction" refers a position that serves as a reference (including region) when the bending molds 3, 5 each are attached to the mold holders 13, 19 of the tables 11, 13, respectively according to the above-mentioned layout mode, and in the embodiment of the present invention, the same number of the mold attachment reference positions as the number of the bending molds 3, 5 are used.

The light-emitting device control part 47 is configured controllably so that the appropriate number of the lower navigating light-emitting devices 29 corresponding to the work positioning reference positions in the horizontal direction on the basis of the work positioning information emit light among the plurality of the lower navigating light-emitting devices 29 emit light as well as the appropriate number of the lower navigating light-emitting devices 29 corresponding to the mold interference reference positions in the horizontal direction on the basis of the work positioning information emit light in a special luminous state (refer to FIG. 4). Here, the "work positioning reference position in the horizontal direction" refers a position that serves as a reference (including region) when the workpiece W is positioned in the horizontal direction with respect to the lower bending mold 5 according to the above-mentioned work positioning mode, and in the embodiment of the present invention, when a plurality of bending parts (parts subjected to bending) Wa exists at a piece of the workpiece W, the same number of work positioning reference positions as the number of the bending parts Wa are used. The "mold interference reference position in the horizontal direction" refers a position that serves as a reference (including region) at which non-bending parts (parts not subjected to bending) Wb at the workpiece W interfere the bending molds 3, 5 when the workpiece W is positioned in the horizontal direction with respect to the lower bending mold 5 according to the above-mentioned work positioning mode, and in the embodiment of the present invention, when a plurality of non-bending parts Wb exists at a piece of the workpiece W, the same number of mold interference reference positions as the number of the non-bending parts Wb are used. The "emit light in a special luminous state" includes emitting light at varied flashing speed of the lower navigating light-emitting devices 29 and emitting light with varied luminescent colors of the lower navigating light-emitting devices 29.

Next, operations in the first embodiment of the present invention will be described.

The bending molds (used bending molds) 3, 5 used for bending is determined by the mold determination part 39 on the basis of the above-mentioned product information and the bending order of the workpiece W is determined by the bending order determination part 41 on the basis of the above-mentioned product information. Subsequently, the mold layout information is determined by the layout information determination part 43 on the basis of the used bending molds 3, 5 and the bending order and the work positioning information is calculated by the positioning information calculation part 45 on the basis of the used bending molds 3, 5, the bending order and the mold layout information.

Then, it is controlled by the light-emitting device control part 47 so that the plurality of navigating light-emitting devices 27, 29 corresponding the mold attachment reference positions in the horizontal direction on the basis of the mold layout information emit light. Thus, the operator can attach the molds to the mold holders according to the layout mode while being guided by light emission of the plurality of the navigating light-emitting devices 27, 29 corresponding to the mold attachment reference positions in the horizontal direction. Further, by performing the above-mentioned operation the same number of times as the number of the bending molds, as shown in FIG. 3, three upper bending molds can be attached to the upper mold holder 13 and three lower bending molds can be attached to the lower mold holder 19 according to the layout mode.

After attaching three upper bending molds 3 to the upper mold holder 13 and three lower bending molds 5 to the lower mold holder 19, as shown in FIG. 4, the light-emitting device control part 47 controls so that the appropriate number of the lower navigating light-emitting devices 29 corresponding to the work positioning reference positions in the horizontal direction on the basis of the work positioning information emit light. Thus, the operator can position the workpiece W in the horizontal direction with respect to the lower bending molds 5 while being guided by light emission of the plurality of corresponding navigating light-emitting devices. At this time, the light-emitting device control part 47 controls so that the appropriate number of the lower navigating light-emitting devices 29 corresponding to a mold interference reference positions in the horizontal direction on the basis of the work positioning information emit light in a special luminous state. Whereby, the operator can position the workpiece W so that the non-bending parts Wb do not enter to the mold interference reference positions in the horizontal direction while being guided by light emission of the appropriate number of lower navigating light-emitting devices 29 corresponding to the mold interference reference positions in a special luminous state. Other than the positioning of the workpiece W in the horizontal direction with respect to the lower bending molds 5, the positioning of the workpiece W in the longitudinal direction with respect to the lower bending molds by striking the end face of the workpiece W against the striking member of the back gauge device from the forward direction.

Following the positioning of the work in the horizontal direction and the longitudinal direction with respect to the lower molds, by moving the lower table in the vertical direction by means of operation of the pair of bending cylinders, a desired bending of the work is performed in cooperation of the upper bending molds and the lower bending molds.

When a plurality of bending parts Wa exist at a piece of work W, the plurality of bending parts Wa may be bent simultaneously or the plurality of bending parts Wa may be bent sequentially.

As mentioned above, in the first embodiment of the present invention, since the plurality of navigating light-emitting devices 27, 29 corresponding to the mold attachment reference positions in the horizontal direction on the basis of the mold layout information can be made to emit light, even when the layout mode is changed, a plurality of bending molds (three upper bending molds and three lower bending molds in the embodiment of the present invention) can be attached to the mold holders 13, 19 according to the changed layout mode while being guided by light emission of the mold attachment reference positions in the horizontal direction on the basis of the mold layout information representing the changed layout mode. For this reason, even when plural types of bending is performed while changing the layout mode, a series of bending processes can be efficiently performed in a short time.

Further, since the operator can position the workpiece W in the horizontal direction with respect to the lower bending molds according to the positioning mode while being guided by light emission of the plurality of lower navigating light-emitting devices 29 corresponding to the work positioning reference positions, operating time for positioning the workpiece W becomes shorter, thereby to improve operating efficiency. For the same reason, even when the workpiece W has a plurality of bending parts Wa or non-bending parts Wb, positioning of the workpiece W in the horizontal direction with respect to the lower bending molds 5 can be performed with a high degree of accuracy, and for example, the plurality of bending parts Wa at the workpiece W can be easily bent simultaneously or the bending parts Wa at the workpiece W can be easily bent while avoiding interference between the non-bending parts Wb and the bending molds 3, 5.

Especially, since the operator can position the workpiece W so that the non-bending parts Wb do not enter to the mold interference reference positions in the horizontal direction while being guided by light emission of the appropriate number of lower navigating light-emitting devices 29 corresponding to the mold interference reference positions in a special luminous state, the above-mentioned effects can be further improved.

Next, a bending machine (a whole of the bending machine is not shown) in accordance with a second embodiment of the present invention will be described with reference to FIG. 6 to FIG. 8.

Figure 6:
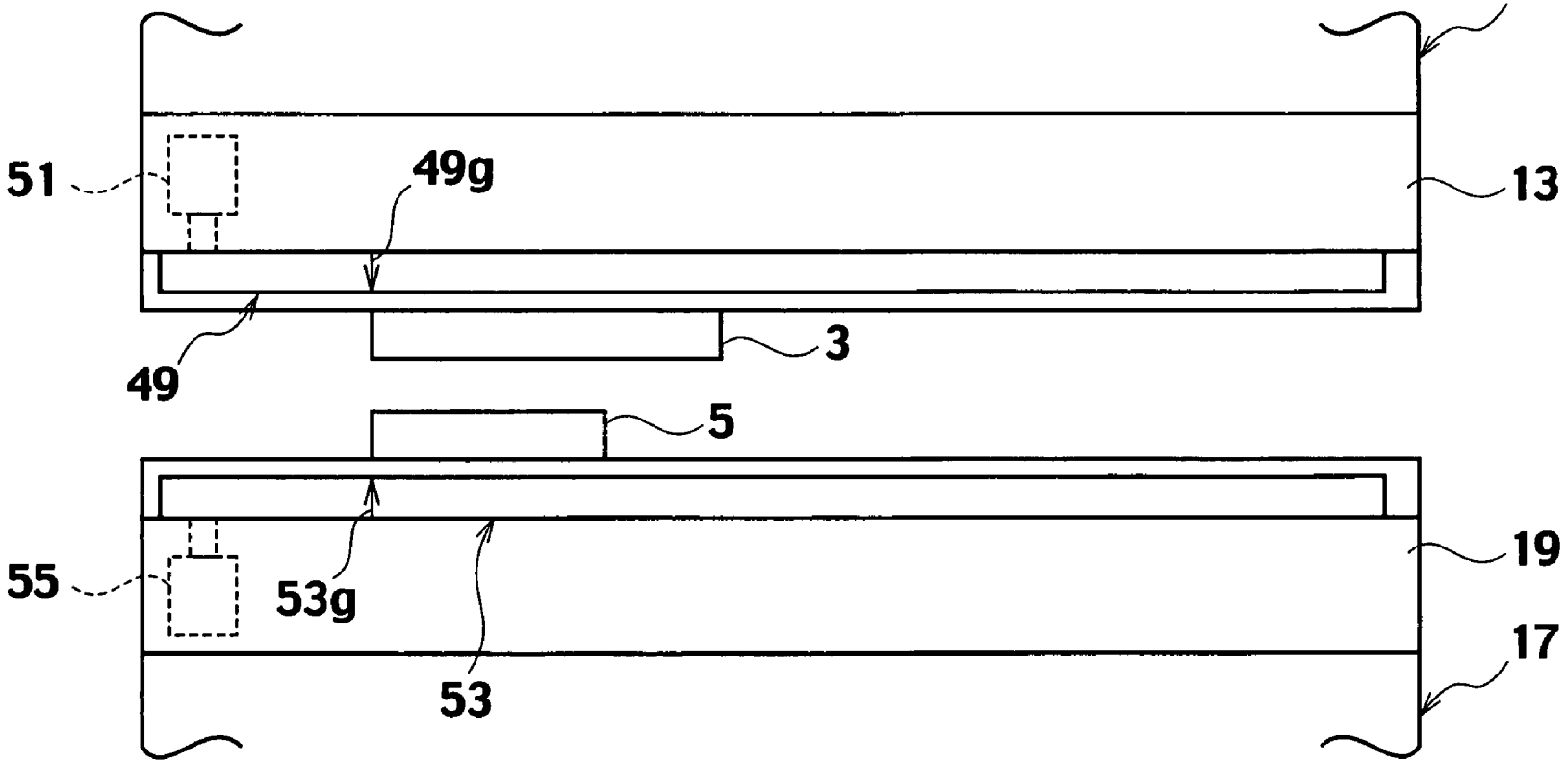
FIG. 6 is a view showing the state where an upper navigating guide part and a lower navigating guide part are located at positions corresponding to the mold attachment reference positions in the horizontal direction.
Figure 7:
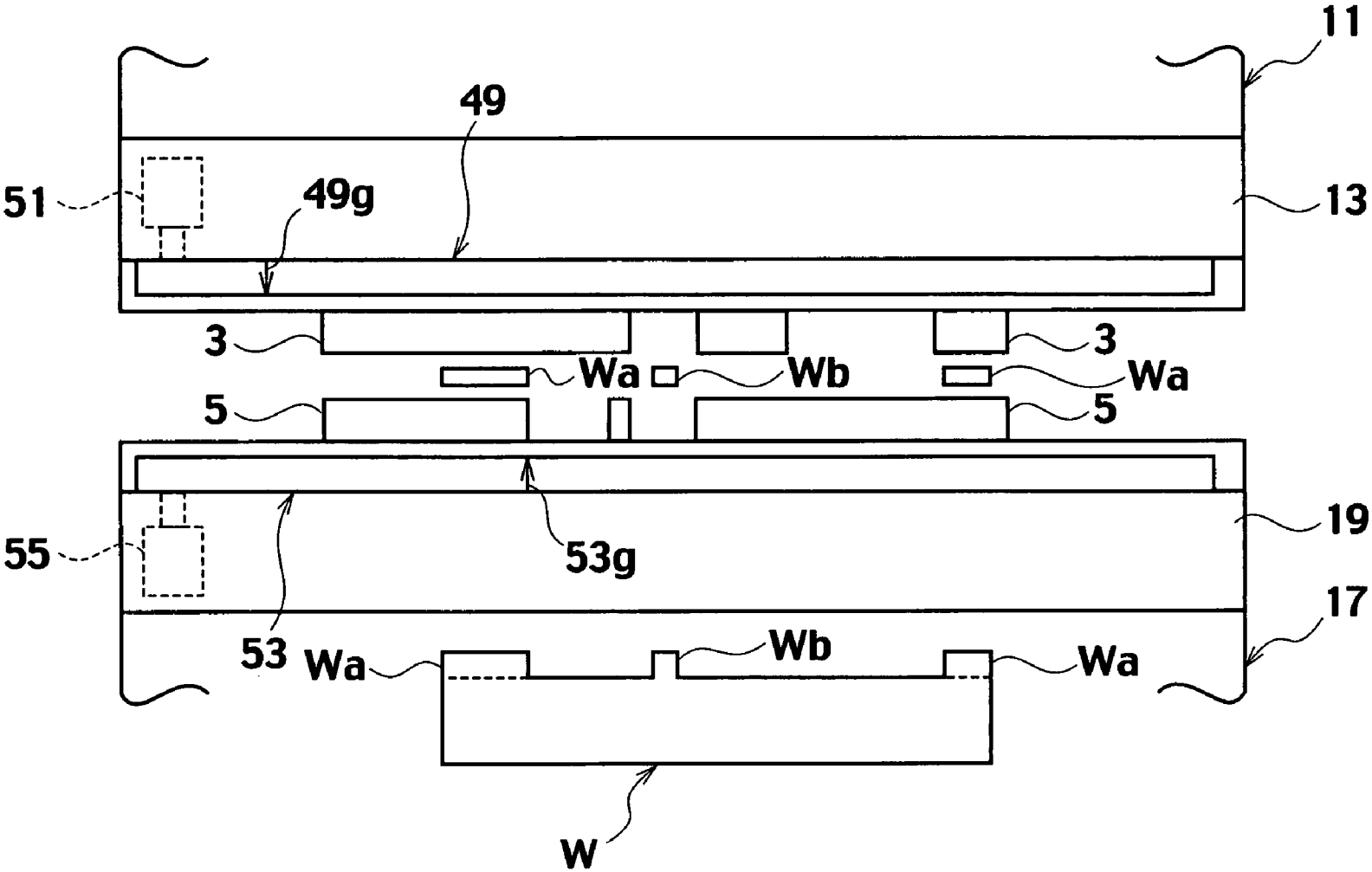
FIG. 7 is a view showing the state where the lower navigating guide part is located at a position corresponding to the work positioning reference position in the horizontal direction.
Figure 8:
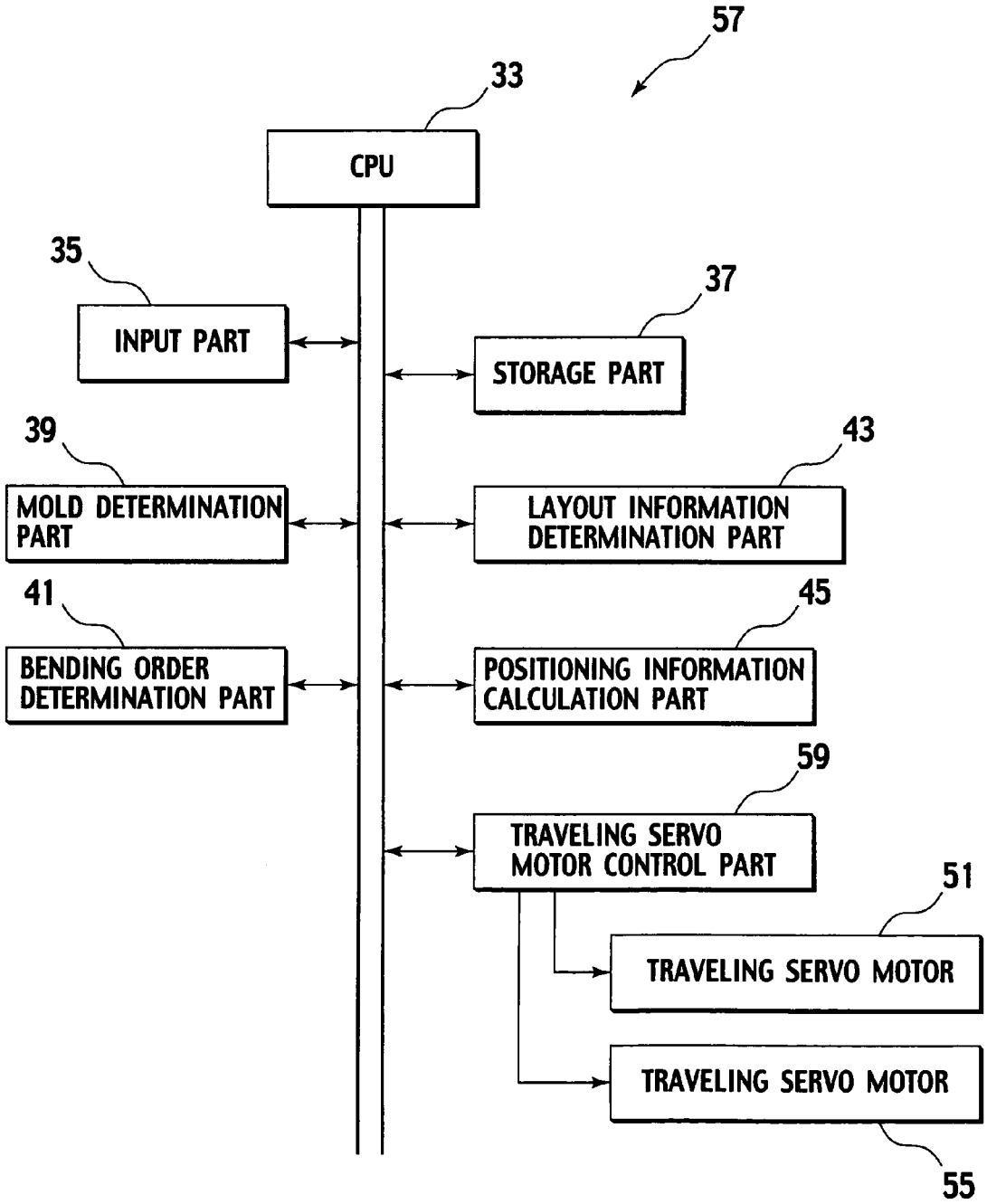
FIG. 8 is a block diagram of an NC device in accordance with a second embodiment of the present invention.

FIG. 6 is a view showing the state where an upper navigating guide part and a lower navigating guide part are located at positions corresponding to the mold attachment reference positions in the horizontal direction, FIG. 7 is a view showing the state where the lower navigating guide part is located at a position corresponding to the work positioning reference position in the horizontal direction and FIG. 8 is a block diagram of an NC device in accordance with the second embodiment of the present invention.

Here, "horizontal" refers right and left in FIG. 6 and FIG. 7, "longitudinal" refers back and front as one faces the sheet in FIG. 6 and FIG. 7, and "vertical" refers up and down in FIG. 6 and FIG. 7.

The bending machine in accordance with the second embodiment of the present invention has the substantially same configuration as the bending machine 1 in accordance with the first embodiment of the present invention and among all components of the bending machine in accordance with the second embodiment of the present invention, components other than the components in the bending machine 1 in accordance with the first embodiment of the present invention will be described below. Among all components of the bending machine in accordance with the second embodiment of the present invention, components similar to the components in the bending machine 1 in accordance with the first embodiment of the present invention are given same reference numerals in the figures and description thereof is not repeated.

As shown In FIG. 6 and FIG. 7, an annular upper navigating belt 49 capable of traveling in the horizontal direction is provided on the front face of the upper mold holder 13 in the bending machine in accordance with the second embodiment of the present invention and this upper navigating belt 49 has a navigating guide part 49*g* for guiding the operator. A traveling servo motor 51 for driving the upper navigating belt 49 in the horizontal direction is provided at an appropriate position of the upper mold holder 13.

Similarly, an annular lower navigating belt 53 capable of traveling in the horizontal direction is provided on the front face of the lower mold holder 19 and this lower navigating belt 53 has a navigating guide part 53*g* for guiding the operator. A traveling servo motor 55 for driving the lower navigating belt 53 in the horizontal direction is provided at an appropriate position of the lower mold holder 19.

To control guidance by the upper navigating belt 9 and the lower navigating belt 53, the bending machine in accordance with the second embodiment of the present invention has an NC device 57 shown in FIG. 8 and similar to the NC device in accordance with the first embodiment of the present invention, this NC device 57 has the CPU 33, the input part 35, the storage part 37, the mold determination part 39, the bending order determination part 41, the layout information determination part 43 and the positioning information calculation part 45 as main components and also has a traveling servo motor control part 59 as a main component.

The traveling servo motor control part 59 is electrically connected to the CPU 47 and specially, has the following configuration.

That is, the traveling servo motor control part 59 can control the traveling servo motors 51, 55 so as to locate the navigating guide parts 49*g*, 53*g* at positions corresponding to the mold attachment reference positions in the horizontal direction on the basis of the mold layout information. Here, the "mold attachment reference position in the horizontal direction" refers to a position (including region) that serves as a reference when the bending molds 3, 5 are attached to the mold holders 13, 19 of the tables 11, 13 according to the layout mode, and in the embodiment of the present invention, the same number of the mold attachment reference positions as the number of the bending molds 3, 5 are used.

Further, the traveling servo motor control part 59 can control the traveling servo motor 55 so as to locate the navigating guide part 53*g* at a position corresponding to the work positioning reference position in the horizontal direction on the basis of the work positioning information. Here, the "work positioning reference position in the horizontal direction" refers to a position (including region) that serves as a reference when the workpiece W is positioned with respect to lower bending mold 5 in the horizontal direction according to the above-mentioned work positioning mode, and in the embodiment of the present invention, even when a plurality of bending parts (parts subjected to bending) Wa exist at a piece of work W, one work positioning reference position is used.

Next, operations in accordance with the second embodiment of the present invention will be described.

Similar to the operations in accordance with the first embodiment of the present invention, the used bending molds 3, 5 are determined and the bending order of the workpiece W is determined. Subsequently, the mold layout information representing the layout mode of the bending molds 3, 5 in the horizontal direction is determined by the layout information determination part 39 on the basis of the used bending molds 3, 5 and the bending order and the work positioning information representing the positioning mode of the workpiece W with respect to the lower bending mold 5 is calculated by the positioning information calculation part 45 on the basis of the used bending molds 3, 5, the bending order and the above-mentioned mold layout information.

Then, the traveling servo motor control part 59 controls the traveling servo motors 51, 55 so as to locate the navigating guide parts 49*g*, 53*g* at positions corresponding to the mold attachment reference positions in the horizontal direction. Thus, the operator can attach the bending molds 3, 5 to the mold holders 13, 19 according to the layout mode while being guided by the navigating guide parts 49*g*, 53*g*. Further, by performing the above-mentioned operation the same number of times as the number of the bending molds 3, 5, as shown in FIG. 6, three upper bending molds 3 can be attached to the upper mold holder and three lower bending molds 5 can be attached to the lower mold holder 19 according to the layout mode.

After attaching three upper bending molds 3 to the upper mold holder 13 and three lower bending molds 5 to the lower mold holder 19, as shown in FIG. 7, the traveling servo motor control part 59 controls the traveling servo motor 55 so as to locate the navigating guide part 53*g* at the position corresponding to the work positioning reference position in the horizontal direction. Thus, the operator can position the workpiece W in the horizontal direction with respect to the lower bending molds 5 while being guided by the navigating guide part 53*g*. Other than the positioning of the workpiece W in the horizontal direction with respect to the lower bending molds 5, the positioning of the workpiece W in the longitudinal direction with respect to the lower bending molds by striking the end face of the workpiece W against the striking member of the back gauge device from the forward direction.

Following the positioning of the work in the horizontal direction and the longitudinal direction with respect to the lower molds, similar to the effects in accordance with the first embodiment of the present invention, by moving the lower table 17 in the vertical direction by means of operation of the pair of bending cylinders 25, a desired bending of the work is performed in cooperation of the upper bending molds 3 and the lower bending molds 5. When a plurality of bending parts Wa exist at a piece of work W, the plurality of bending parts Wa may be bent simultaneously or the plurality of bending parts Wa may be bent sequentially.

As mentioned above, in the second embodiment of the present invention, since the navigating guide parts 49*g*, 53*g* can be located at positions corresponding to the mold attachment reference positions in the horizontal direction on the basis of the mold layout information, even when the layout mode is changed, a plurality of bending molds (three upper bending molds and three lower bending molds in the embodiment of the present invention) can be attached to the mold holders 13, 19 according to the changed layout mode while being guided by the navigating guide parts 49*g*, 53*g* located at positions corresponding the mold attachment reference positions in the horizontal direction on the basis of the mold layout information representing the changed layout mode. For this reason, even when plural types of bending is performed while changing the layout mode, a series of bending processes can be efficiently performed in a short time without adding complicated operations.

Further, since the operator can position the workpiece W in the horizontal direction with respect to the lower bending molds 5 according to the positioning mode while being guided by the navigating guide part 53*g* located at the position corresponding to the work positioning reference position, operating time for positioning the workpiece W becomes shorter, thereby to improve operating efficiency. For the same reason, even when the workpiece W has a plurality of bending parts Wa or non-bending parts Wb, positioning of the workpiece W in the horizontal direction with respect to the lower bending molds 5 can be performed with a high degree of accuracy, and for example, the plurality of bending parts Wa at the workpiece W can be easily bent simultaneously or the bending parts Wa at the workpiece W can be easily bent while avoiding interference between the non-bending parts Wb and the bending molds 3, 5.

Next, a third embodiment of the present invention will be described with reference to FIG. 9 to FIG. 13.

Figure 9:
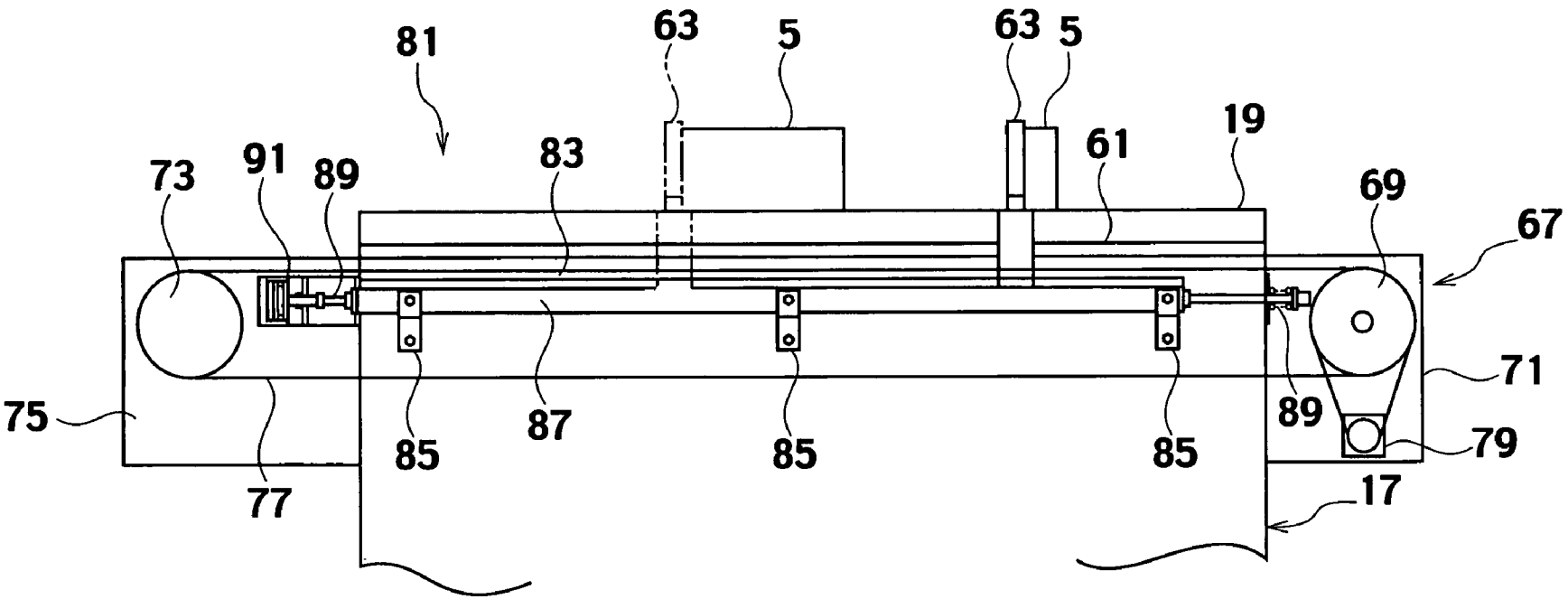
FIG. 9 is view showing a main part of a bending machine in accordance with a third embodiment of the present invention.
Figure 10:
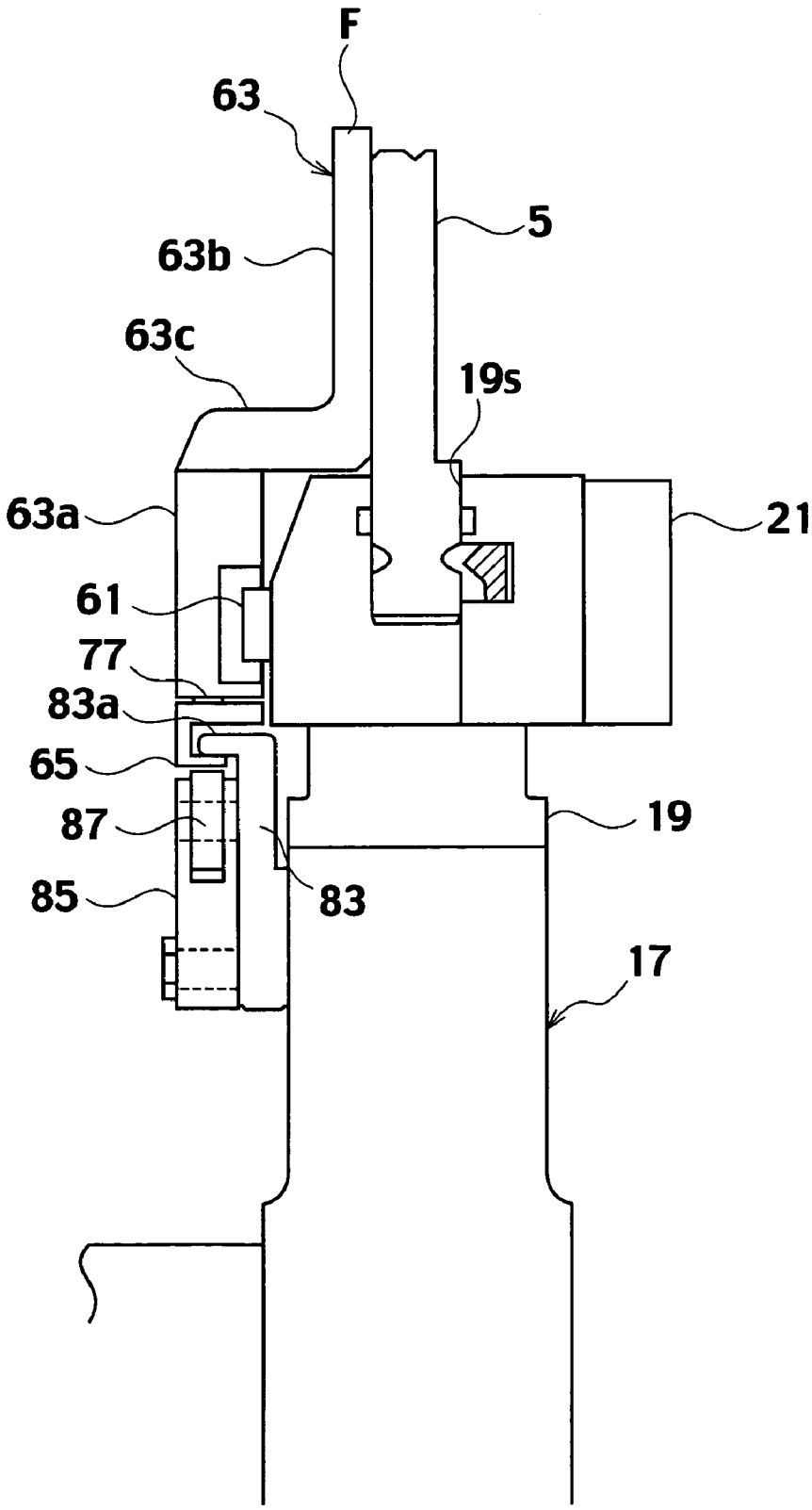
FIG. 10 is a side view showing the device sectioned at an appropriate location.
Figure 11:
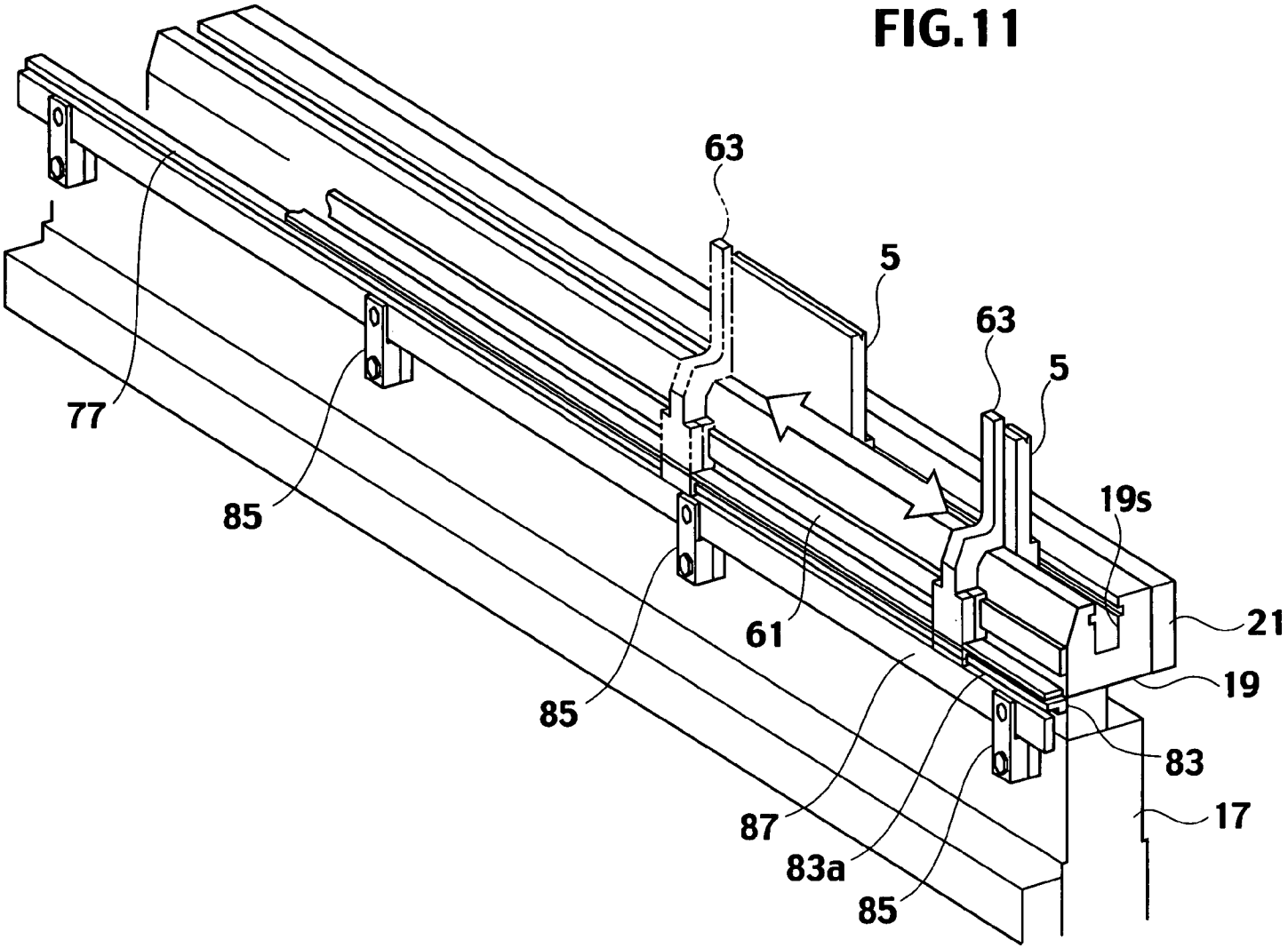
FIG. 11 is a perspective view showing the state where a navigating pin is located at a position corresponding to the mold attachment reference position in the horizontal direction.
Figure 12:
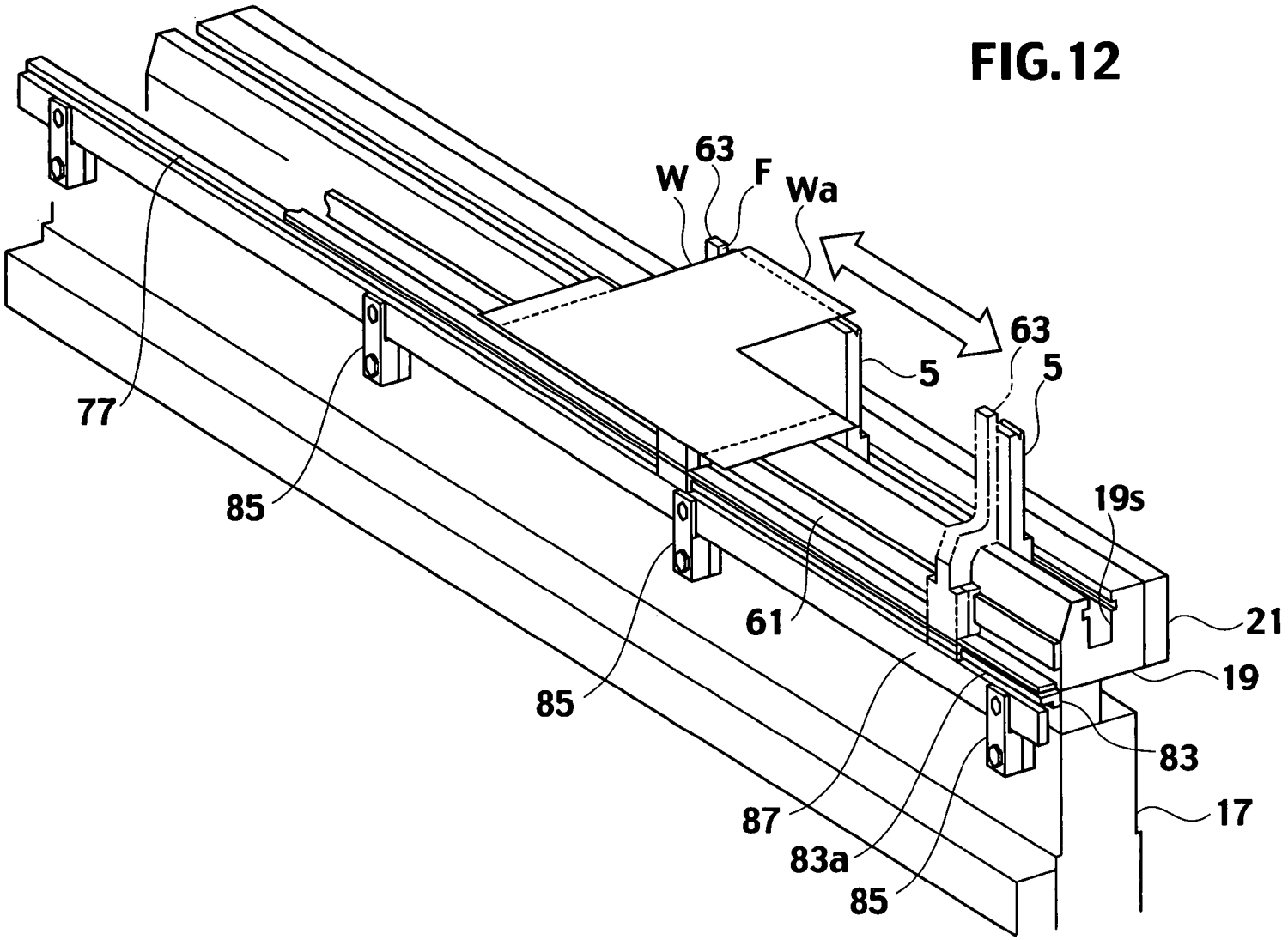
FIG. 12 is a perspective view showing the state where the navigating pin is located at a position corresponding to the work positioning reference position in the horizontal direction.
Figure 13:
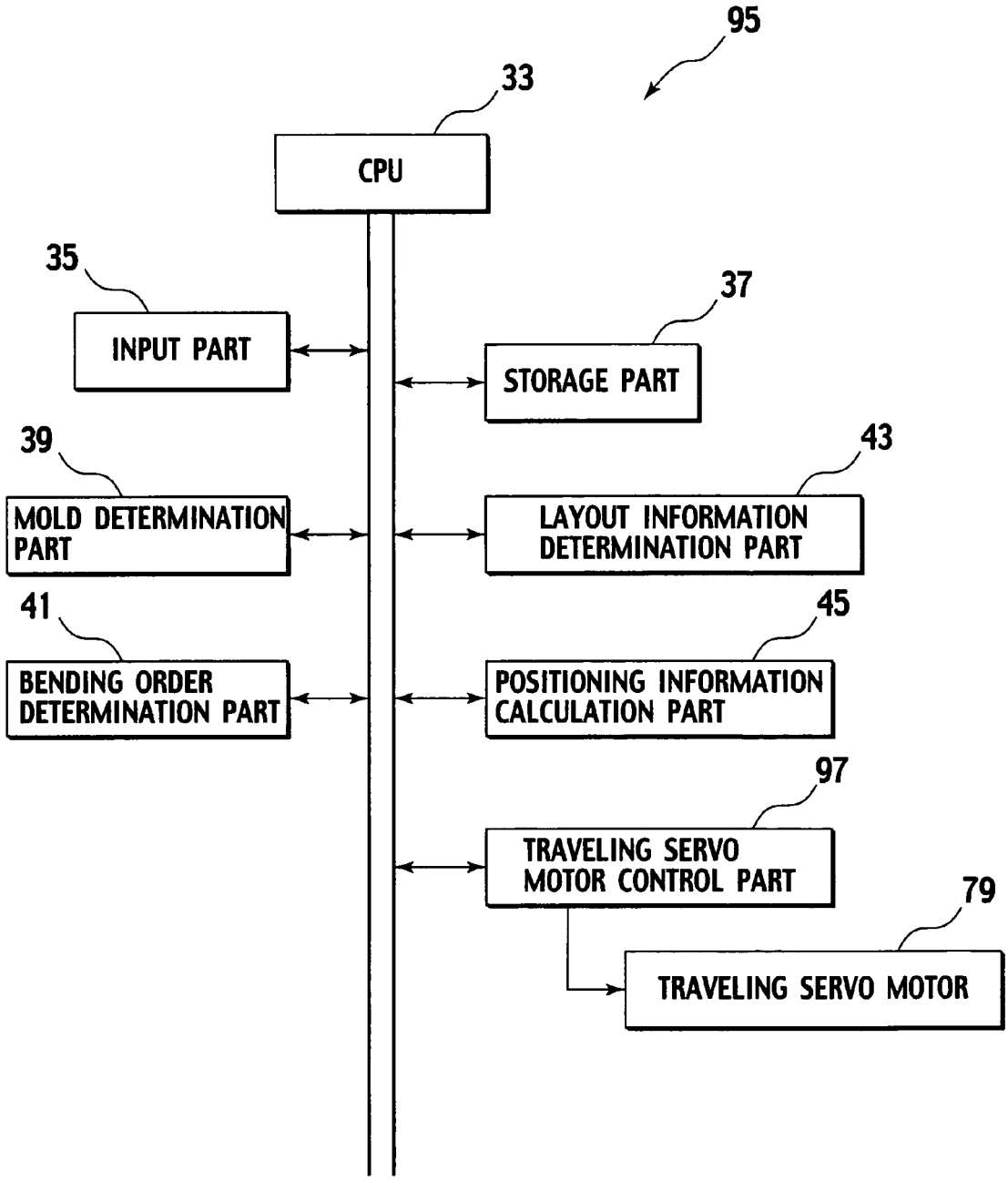
FIG. 13 is a block diagram of an NC device in accordance with the third embodiment of the present invention.

FIG. 9 is a view showing a main part of a bending machine in accordance with the third embodiment of the present invention, FIG. 10 is a view taken along the line I-I of FIG. 9, FIG. 11 is a perspective view showing the state where a navigating pin (navigating member) is located at a position corresponding to the mold attachment reference position in the horizontal direction, FIG. 12 is a perspective view showing the state where a navigating pin is located at a position corresponding to the work positioning reference position in the horizontal direction and FIG. 13 is a block diagram of an NC device in accordance with the third embodiment of the present invention.

Here, "horizontal" refers right and left in FIG. 9 and back and front as one faces the sheet in FIG. 10, "longitudinal" refers back and front as one faces the sheet in FIG. 9 and right and left in FIG. 10, and "vertical" refers up and down in FIG. 9 and FIG. 19.

The bending machine in accordance with the third embodiment of the present invention (the whole of the bending machine is not shown) has the substantially same configuration as the bending machine 1 in accordance with the first embodiment of the present invention and among all components of the bending machine in accordance with the third embodiment of the present invention, components other than the components in the bending machine 1 in accordance with the first embodiment of the present invention will be described below. Among all components of the bending machine in accordance with the third embodiment of the present invention, components similar to the components in the bending machine 1 in accordance with the first embodiment of the present invention are given same reference numerals in the figures and description thereof is not repeated.

As shown in FIG. 9 and FIG. 10, a pin guide 61 extending in the horizontal direction is provided at the front face of the lower mold holder 19 and the pin guide 61 is provided with a navigating pin 63 for guiding the operator so as to be movable in the horizontal direction. The navigating pin 63 is comprised of a first vertical part 63*a* supported by the pin guide 61 so as to be movable in the horizontal direction, a second vertical part 63*b* arranged in a slightly rearward position to the first vertical part 63*a* and a horizontal part 63*c* connecting the first vertical part 63*a* and the second vertical part 63*b*. An L-like clamped piece 65 is formed integrally with a lower side of the first vertical part 63*a* in the navigating pin 63 and the second vertical part 63*b* in the navigating pin 63 has a striking face F that can be struck by the end face of the workpiece W from the right direction.

A pin transfer device 67 for transferring the navigating pin 63 in the horizontal direction is provided at the lower table 17.

That is, a driving pulley 69 is provided rotatably on the right side of the lower table 17 via a bracket 71 and a driven pulley 73 separate from the driving pulley 69 is provided rotatably on the left side of the lower table 17 via a bracket 75. A circular timing belt 77 is formed so as to wind around the driving pulley 69 and the driven pulley 73 and a part of the timing belt 77 is connected to the navigating pin 63. A traveling servo motor 79 is provided on the lower table 17 via a bracket 71 and the driven pulley 69 is interlocked to an output shaft of the traveling servo motor 79 through an appropriate connecting means.

Therefore, the navigating pin 63 can be moved by the driving of the traveling servo motor 79 in the horizontal direction through the driving pulley 69, the driven pulley 73 and the timing belt 77.

Further, a pin fixing device 81 is provided for fixing the navigate pin 63 so as not to move in the horizontal direction with respect to the lower table 17.

That is, a fixing bar 83 extending in the horizontal direction is provided on the front face of the lower table 17 and a fixing piece 83*a* extending in the horizontal direction is provided on the fixing bar 83. A plurality of swinging links 85 capable of swinging in the vertical direction is provided below the fixing piece 83*a* and base parts of the plurality of swinging links 85 are each rotatably connected to the lower table 17. A clamping bar 87 extending in the horizontal direction is provided at front end parts of the plurality of swinging links 85 and serves to clamp the clamped piece 65 in the vertical direction in cooperation with the fixing piece 83*a*. A clamping air cylinder 91 with a piston rod 89 connected to the left end of the clamping bar 87 is provided on the left side of the lower table 17 via the bracket 7 and serves to transfer the clamping bar 87 in the vertical direction while swinging the plurality of swinging links 85 in the vertical direction. A spring 93 urging the clamping bar 87 in the right direction (unclamping direction of releasing clamping) is provided at an appropriate position on the right side of the lower table 17.

Accordingly, the clamping bar 87 is transferred upwards while swinging the plurality of swinging links 85 upwards by the operation of the clamping air cylinder 91. This enables clamping the clamped piece 65 in cooperation of the clamp bar 87 and the fixing piece 83*a* and fixing the navigating pin 63 so as not to move in the horizontal direction with respect to the lower table 17. The clamping bar 87 is transferred downwards by urging force of the spring 93 while swinging the plurality of swinging links 85 downwards and the operation of the clamping air cylinder 91. This enables releasing the clamping state of the clamped piece 65 and making the navigating pin 63 movable in the horizontal direction with respect to the lower table 17.

To control guidance by the navigating pin 63, the bending machine in accordance with the third embodiment of the present invention has an NC device 95 shown in FIG. 13 and similar to the NC device 31 in accordance with the first embodiment of the present invention, this NC device 95 has the CPU 33, the input part 35, the storage part 37, the mold determination part 39, the bending order determination part 41, the layout information determination part 43 and the positioning information calculation part 45 as main components and also has a traveling servo motor control part 97 for controlling the traveling servo motor 79 as a main component.

The traveling servo motor control part 97 is electrically connected to the CPU 33 and specially, has the following configuration.

That is, the traveling servo motor control part 97 can control the traveling servo motor 79 so as to locate the navigating pin 63 at a position corresponding to the mold attachment reference position in the horizontal direction on the basis of the mold layout information (refer to FIG. 11). Here, the "mold attachment reference position in the horizontal direction" refers to a position (including region) that serves as a reference when the bending molds 3, 5 are attached to the mold holders 13, 19 of the tables 11, 13 according to the layout mode, and in the embodiment of the present invention, the same number of the mold attachment reference positions as the number of the bending molds 3, 5 are used.

Further, the traveling servo motor control part 97 can control the traveling servo motor 79 so as to locate the navigating pin 63 at a position corresponding to the work positioning reference position in the horizontal direction on the basis of the work positioning information (refer to FIG. 12). Here, the "work positioning reference position in the horizontal direction" refers to a position (including region) that serves as a reference when the workpiece W is positioned with respect to lower bending mold 5 in the horizontal direction according to the above-mentioned work positioning mode, and in the embodiment of the present invention, even when a plurality of bending parts (parts subjected to bending) Wa exist at a piece of work W, one work positioning reference position is used.

Next, operations in accordance with the third embodiment of the present invention will be described.

Similar to the operations in accordance with the first embodiment of the present invention, the used bending molds 3, 5 are determined and the bending order of the workpiece W is determined. Subsequently, the mold layout information representing the layout mode of the bending molds 3, 5 in the horizontal direction is determined by the layout information determination part on the basis of the used bending molds 3, 5 and the bending order, and the work positioning information representing the positioning mode of the workpiece W with respect to the lower bending mold 5 is calculated by the positioning information calculation part 45 on the basis of the used bending molds 3, 5, the bending order and the above-mentioned mold layout information.

Then, the traveling servo motor control part 97 controls the traveling servo motor 79 so as to locate the navigating pin 63 at a position corresponding to the mold attachment reference position in the horizontal direction. Thus, the operator can attach the bending molds to the mold holders 1, 19 according to the layout mode while being guided by the navigating pin 63. Further, by performing the above-mentioned operation the same number of times as the number of the bending molds, two upper bending molds 3 can be attached to the upper mold holder 13 (not shown) and two lower bending molds 5 can be attached to the lower mold holder 19 (refer to FIG. 11) according to the layout mode.

After attaching two upper bending molds 3 to the upper mold holder 13 and two lower bending molds 5 to the lower mold holder 19, the traveling servo motor control part 97 controls the traveling servo motor 79 so as to locate the navigating pin 63 at the position corresponding to the work positioning reference position in the horizontal direction. Thus, as shown in FIG. 12, the operator can position the workpiece W in the horizontal direction with respect to the lower bending molds 5 while being guided by the navigating pin 63. Here, when positioning the workpiece W in the horizontal direction, as mentioned above, the end face of the workpiece W is struck against the striking face F of the navigating pin 63 from the right direction in the state where the navigating pin 63 is fixed by the pin fixing means 81 so as not to move in the horizontal direction with respect to the lower table 17. Other than the positioning of the workpiece W in the horizontal direction with respect to the lower bending molds 5, it is preferred that the positioning of the workpiece W in the longitudinal direction with respect to the lower bending molds by striking the end face of the workpiece W against the striking member of the back gauge device from the forward direction.

Following the positioning of the work in the horizontal direction and the longitudinal direction with respect to the lower molds 5, similar to the effects in accordance with the first embodiment of the present invention, by moving the lower table 17 in the vertical direction by means of operation of the pair of bending cylinders 25, a desired bending of the workpiece W is performed in cooperation of the upper bending molds 3 and the lower bending molds 5. When a plurality of bending parts Wa exist at a piece of work W, as shown in FIG. 12, the plurality of bending parts Wa may be bent sequentially or in the case of the workpiece W as shown in FIG. 4, the plurality of bending parts Wa may be bent simultaneously.

As mentioned above, in the third embodiment of the present invention, since the navigating pin 63 can be located at the position corresponding to the mold attachment reference position in the horizontal direction on the basis of the mold layout information, even when the layout mode is changed, a plurality of bending molds (two upper bending molds and two lower bending molds in the embodiment of the present invention) can be attached to the mold holders 13, 19 according to the changed layout mode while being guided by the navigating pin 63 located at the position corresponding the mold attachment reference position in the horizontal direction on the basis of the mold layout information representing the changed layout mode. For this reason, even when plural types of bending is performed while changing the layout mode, a series of bending processes can be efficiently performed in a short time without adding complicated operations.

Further, since the operator can position the workpiece W in the horizontal direction with respect to the lower bending molds 5 according to the positioning mode while being guided by the navigating pin 63 located at the position corresponding to the work positioning reference position, operating time for positioning the workpiece W becomes shorter, thereby to improve operating efficiency. For the same reason, even when the workpiece W has a plurality of bending parts Wa or non-bending parts Wb, positioning of the workpiece W in the horizontal direction with respect to the lower bending molds 5 can be performed with a high degree of accuracy, and for example, the plurality of bending parts Wa at the workpiece W can be easily bent simultaneously or the bending parts Wa at the workpiece W can be easily bent while avoiding interference between the non-bending parts Wb and the bending molds 3, 5.

Further, since the end face of the workpiece W is struck against the striking face of the navigating pin 63 from the right direction in the state where the navigating pin 63 is fixed so as not to move in the horizontal direction with respect to the lower table 17, positioning accuracy of the workpiece W in the horizontal direction with respect to the lower bending molds 5 becomes higher.

Furthermore, the fixing bar 83 and the clamping bar 87 extend in the horizontal direction and the clamped piece 65 is clamped in the vertical direction by cooperation of the clamping bar 87 and the fixing piece of the fixing bar 83, a length of the pin fixing device 81 in the longitudinal direction can be reduced as much as possible. For this reason, when the workpiece W is bent, the part bent previously can be prevented from interfering with the pin fixing device 81.

Next, a bending machine in accordance with a fourth embodiment of the present invention will be described with reference to FIG. 13 to FIG. 17. Since the NC device 95 in the bending machine in accordance with the third embodiment of the present invention can be used as an NC device, detailed description of consideration of the NC device is not repeated.

Figure 14:
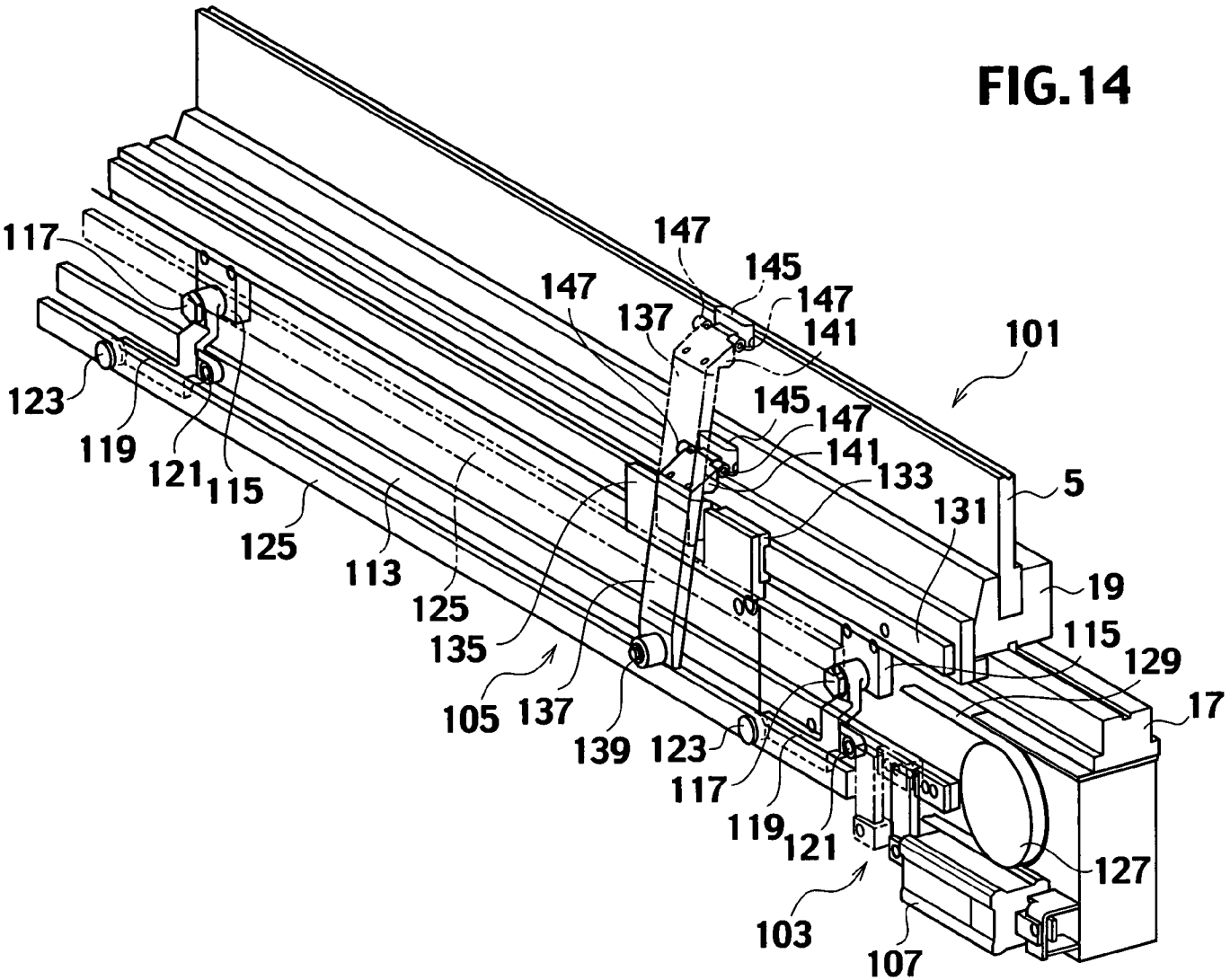
FIG. 14 is a perspective view showing a main part of a bending machine in accordance with a fourth embodiment of the present invention.

FIG. 14 is a perspective view of a navigating mechanism 101. A toothed pulley 127 driven rotatably is provided at the lower table 17 and a toothed endless belt 129 is hanged on the toothed pulley 127. Further, a rail 131 extending in the horizontal direction of the device is attached to the lower table 17. A pair of sliders 133 capable of sliding in the horizontal direction of the device are provided at the rail 131 and a carriage 135 is attached to the pair of sliders 133. The endless belt 129 is fixed at the lower part of the carriage 135.

Figure 16:
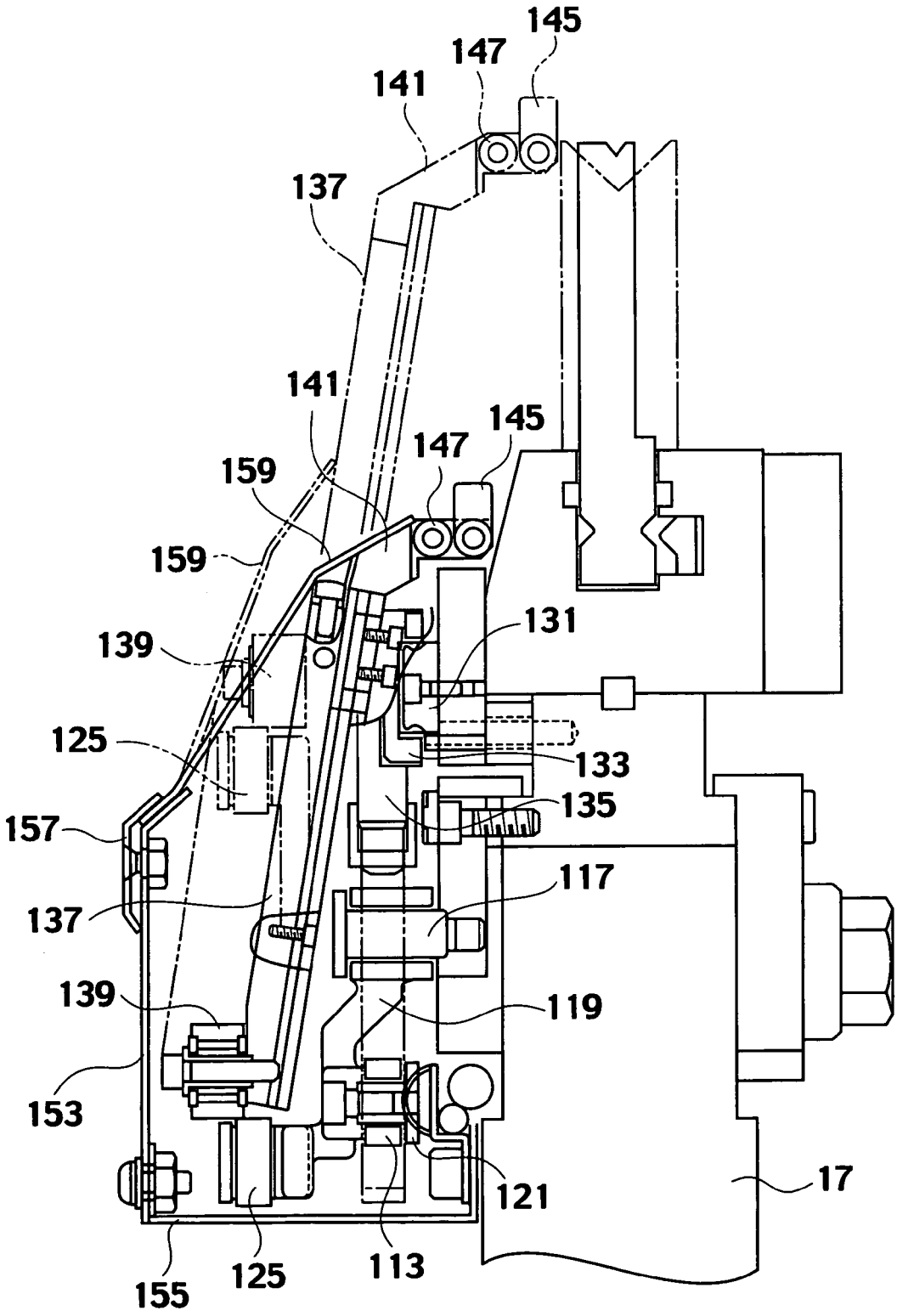
FIG. 16 is a partial sectional side view showing a main part of the bending machine in accordance with the fourth embodiment of the present invention.

As shown in FIG. 16, a lifting 137 that can freely move up and down the carriage 135 substantially in the vertical direction is provided slidably at the carriage 135 and a head part 141 is formed at the upper part of the carriage 135. On the other hand, a roller 139 is axially supported so as to rotate freely at the lower part of the carriage 135.

Further, at the lower table 17, an L-like member 119 in the shape of a bell crank is axially supported around a supporting shaft 117 so as to rotate freely. The cylinder 107 is swingably provided at the lower table 17 and a connector 111 is fixed to a piston rod 109. Further, a horizontal traveling bar 113 extending in the horizontal direction is fixed to the connector 111.

A midpoint of the L-like member 119 is pivotally supported by the horizontal traveling bar 113 via a shaft 121. On the other hand, a front end of the L-like member 119 is pivotally supported by a vertical traveling bar 125 via a shaft 123. The vertical traveling bar 125 is located below the roller 139.

Figure 15:
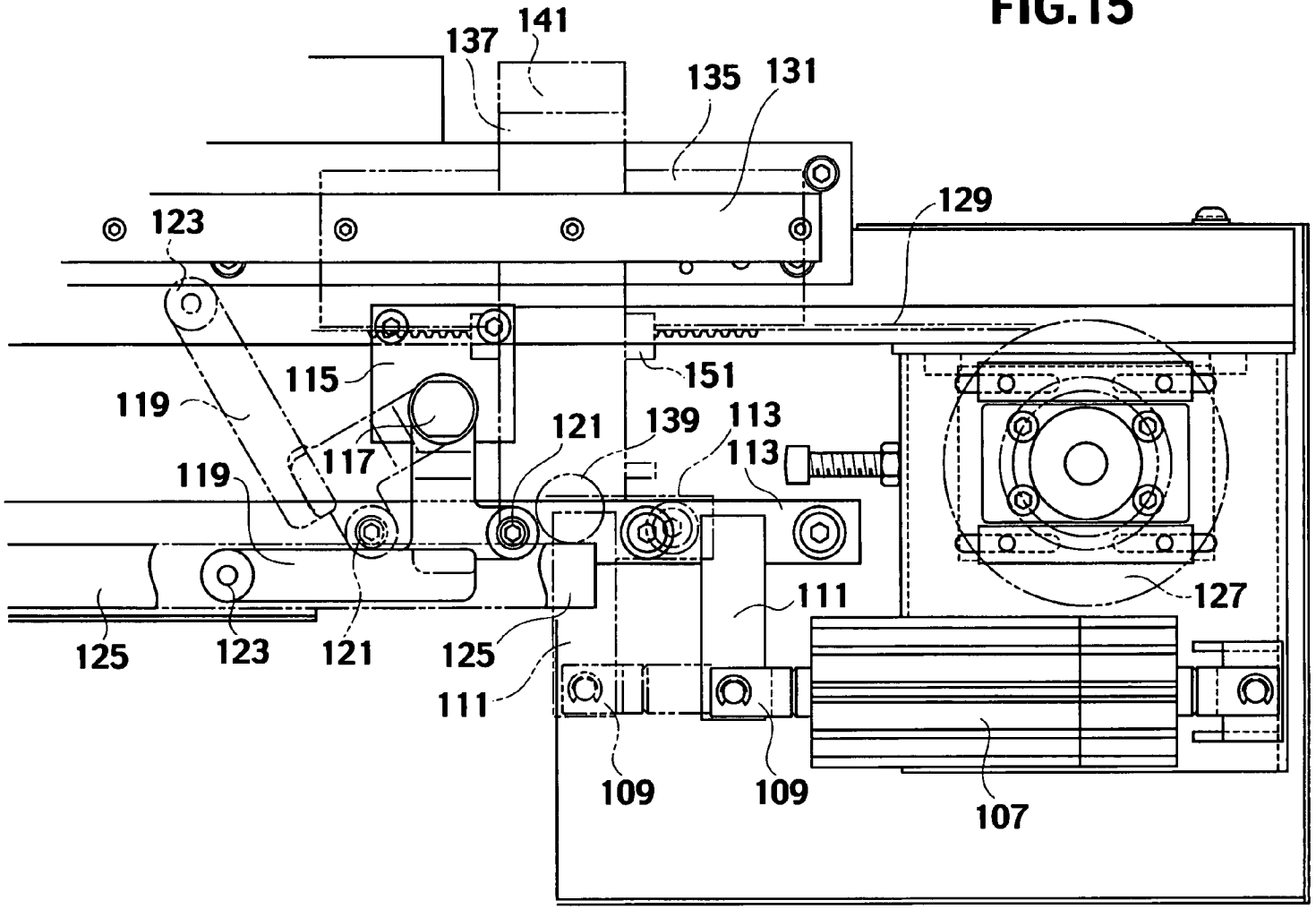
FIG. 15 is partial enlarged view showing a main part of the bending machine in accordance with the fourth embodiment of the present invention.

With the above-mentioned configuration, when the cylinder 107 is extended, in FIG. 15, the piston rod 109, the connector 111 and the horizontal traveling bar 113 moves substantially in the left direction (positions represented by chain double-dashed lines). Further, the L-like member 119 rotates clockwise around the supporting shaft 117. Due to the rotation, the front end of the L-like member 119 ascends (positions represented by chain double-dashed lines) and the shaft 123 also ascends, thereby to raise the vertical traveling bar 125.

Accordingly, since the roller 139 that comes in contact with an upper face of the vertical traveling bar 125 also ascends, the lifting member 137 also ascends (positions represented by chain double-dashed lines). When the lifting member 137 ascends, as shown FIGS. 17A, C, the head part 141 also ascends and a locating member 145 pivotally supported by the head part 141 via a shaft 151 moves to the position to be contacted with the workpiece W. At this time, the workpiece W is placed on a mounting base 147 provided at the head part 141. A top face of the mounting base 147 is formed to have the same level as the top face of the lower bending mold 5. Therefore, since the work comes in contact with the lower bending mold 5 accurately by placing the work on the mounting base 147, positioning can be achieved accurately. This improves bending accuracy.

Figure 17A:
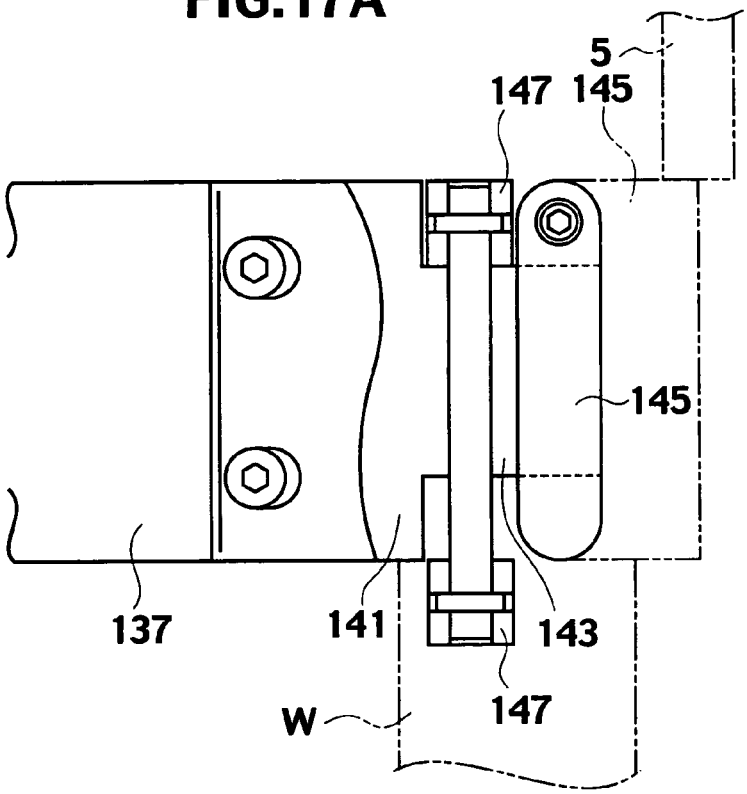
FIGS. 17A-C are front, side and tops views showing a locating member of the bending machine in accordance with the fourth embodiment of the present invention.
Figure 17B:
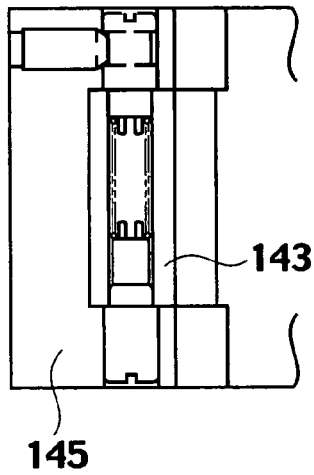
Figure 17C:
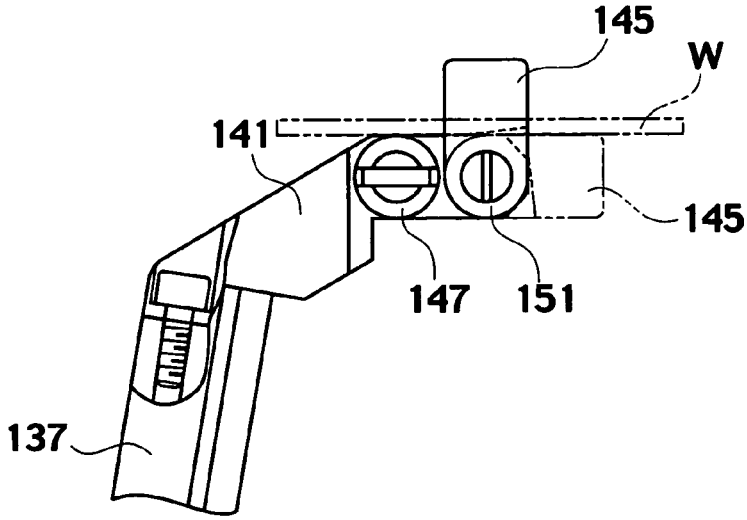

On the other hand, when the locating member 145 is rotated clockwise around the shaft 151 up to the position represented by a chain double-dashed line in FIG. 17C, as shown in FIG. 17A, the locating member 145 moves to the position to be contacted with the lower bending mold 5.

Therefore, by moving the lower bending mold 5 in the vertical direction in the FIG. 17A and bringing the lower bending mold 5 into contact with the locating member 145 represented by a chain double-dashed line in FIG. 17A, the operator can arrange and fix the lower bending mold 5 at a predetermined position. Also, by moving the workpiece W in the vertical direction in the FIG. 17A and bringing the workpiece W into contact with the locating member 145 represented by a solid line in FIG. 17C, the operator can position the workpiece W at a predetermined position.

When positioning and bending is finished, the cylinder 107 is constricted and the lifting member 137 is lowered to a position represented by a solid line in FIG. 14. Subsequently, the servo motor 79 is rotationally driven by the traveling servo motor control part 97 shown in FIG. 13, thereby to rotate the pulley 127. Whereby, the lifting member 137 is moved to a desired appropriate position in the horizontal direction through the belt 129 and the carriage 135. Following the positioning of the lifting member 137 in the horizontal direction, the cylinder 107 is extended again and the lifting member 137 is raised to repeat the same operation process.

Since the lifting member 137 is lowered when moving in the horizontal direction, the lifting member 137 is covered with a cover 159 formed of rubber, flexible resin and the like. Since the other above-mentioned mechanisms are covered with covers 153, 155, contact with the operator is avoided for safety.

Figure 18:
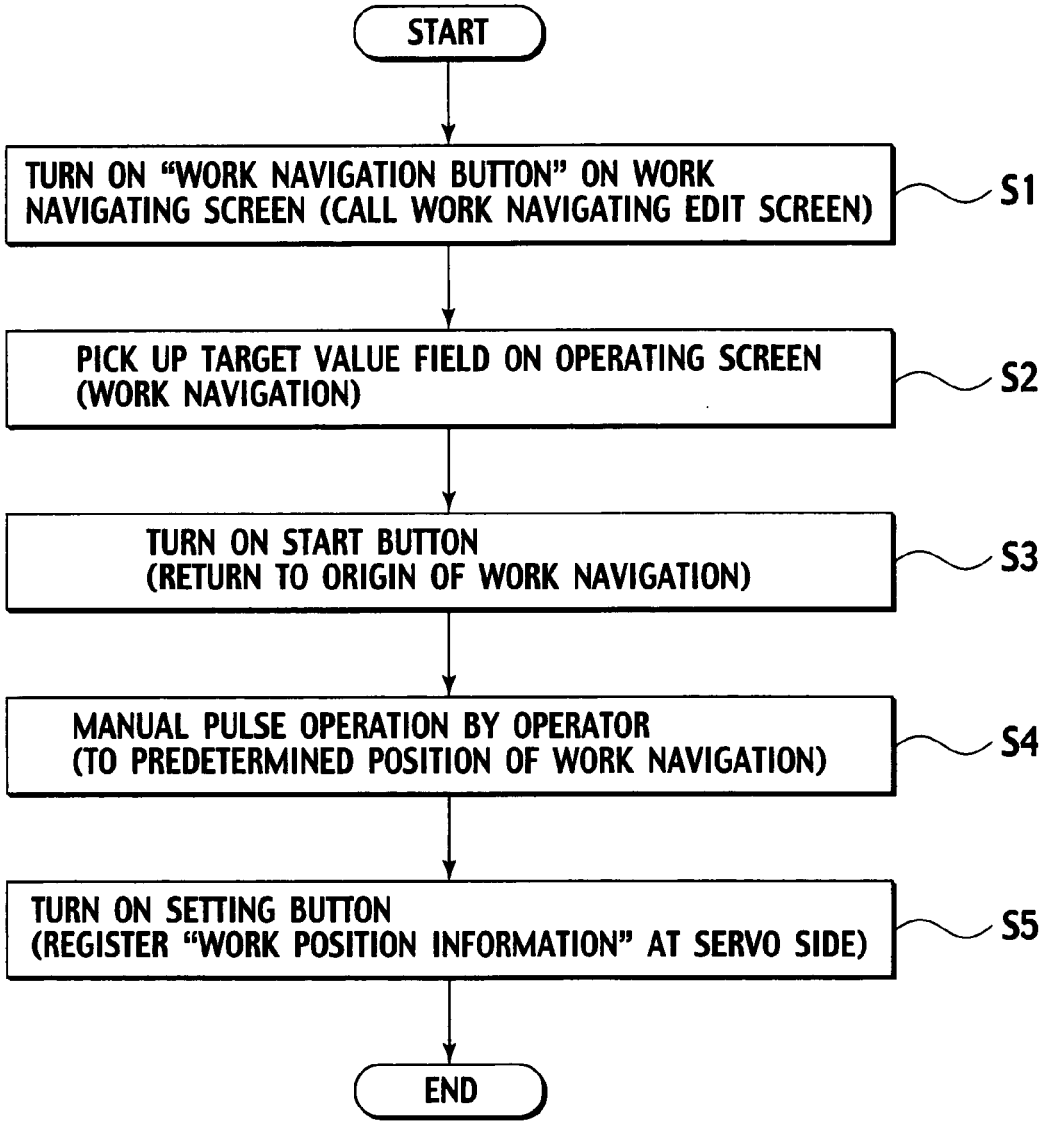
FIG. 18 is a view showing a flow for correcting a working position of the locating member by manual pulse operation.
Figure 19A:
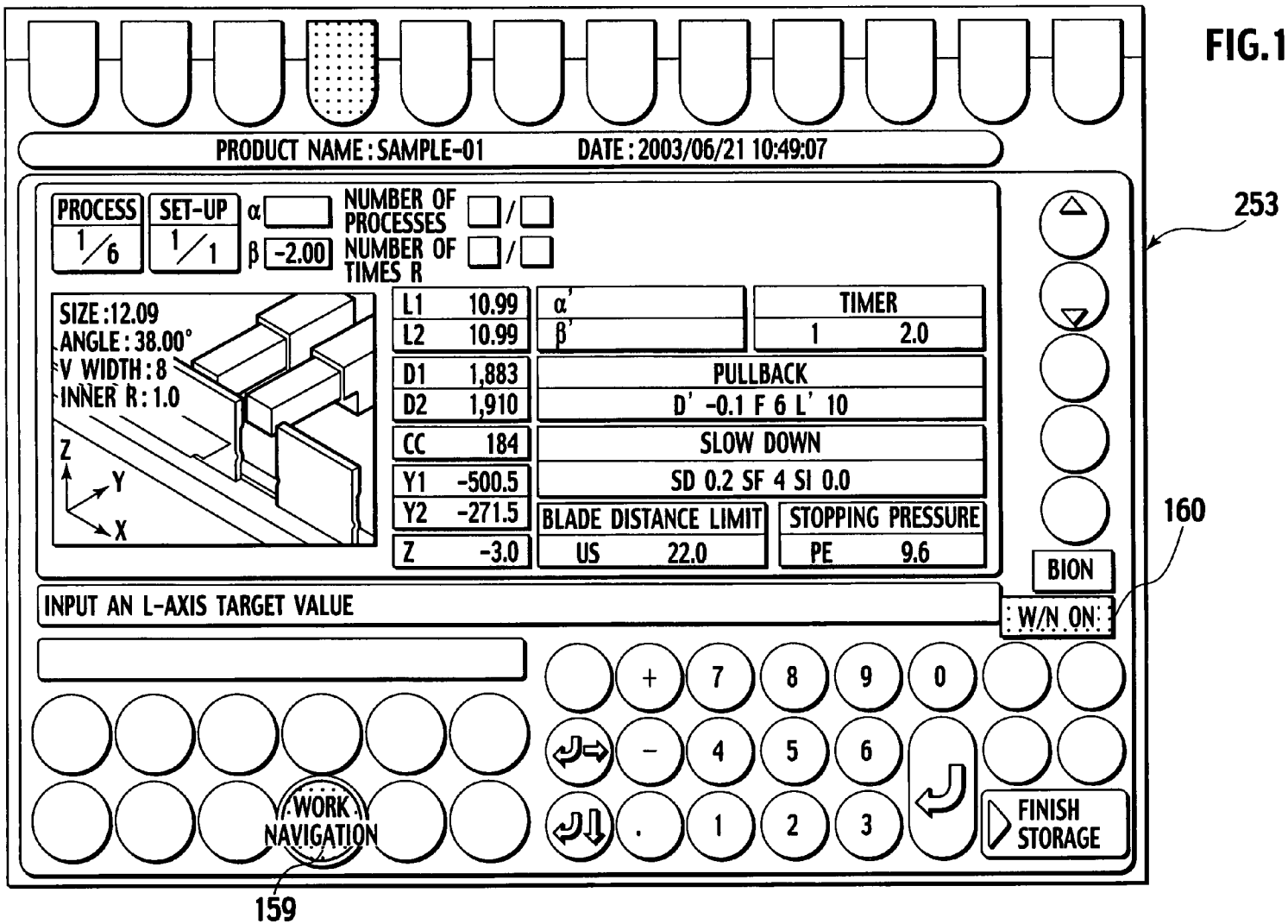
FIGS. 19A and 19B are views showing operation displays in correcting a working position of the locating member by manual pulse operation.

Next, manual positioning of the locating member 145 will be described with reference to FIG. 13, FIG. 18 and FIG. 19. When the position of the locating member 145 in the horizontal direction is determined and trial bending is actually performed in the above-mentioned third and fourth embodiments, some positional correction in the horizontal direction becomes necessary. In this case, the operator makes correction through a display device 253 provided at the CPU 33. Firstly, by pressing a work navigating button 159, a normal working screen (FIG. 19A) is switched to a work navigating screen (FIG. 19B) (S1). Secondly, by picking up (clicking) a target value field on the operating screen of the display device 253, a window for manual setting 157 (manual pulse) is opened (S2).

Further, when a manual pulse switch button 160 is pressed, the servo motor 79 is operated and the locating member 145 (navigating member) returns to an origin in the horizontal direction (Y-axis) (S3). Subsequently, in the state where the window for manual setting 157 is observed to operate the traveling servo motor 79 by manual setting operation, a manual pulsar is rotated and the traveling servo motor 79 is operated while a displayed value 167 showing a present position of the locating member 145 in the horizontal direction (Y-axis) is checked, and when the locating member 145 (navigating member) reaches a desired position, operation of the manual pulsar is stopped, thereby to stop rotation of the servo motor 79 (S4).

When an appropriate correction position of the locating member 145 is determined by the above-mentioned operation, a correction value is manually input into the storage part 37 (FIG. 13) by pressing an execution button 163 as a setting button (S5). Once the correction value is input into the storage part 37, in the next production lot, the locating member 145 is automatically positioned at the above-mentioned correction position. Accordingly, providing that an experienced person performs the first correction operation by manual pulse, even a beginner can perform bending like an experienced person in the next processing.

Figure 19B:
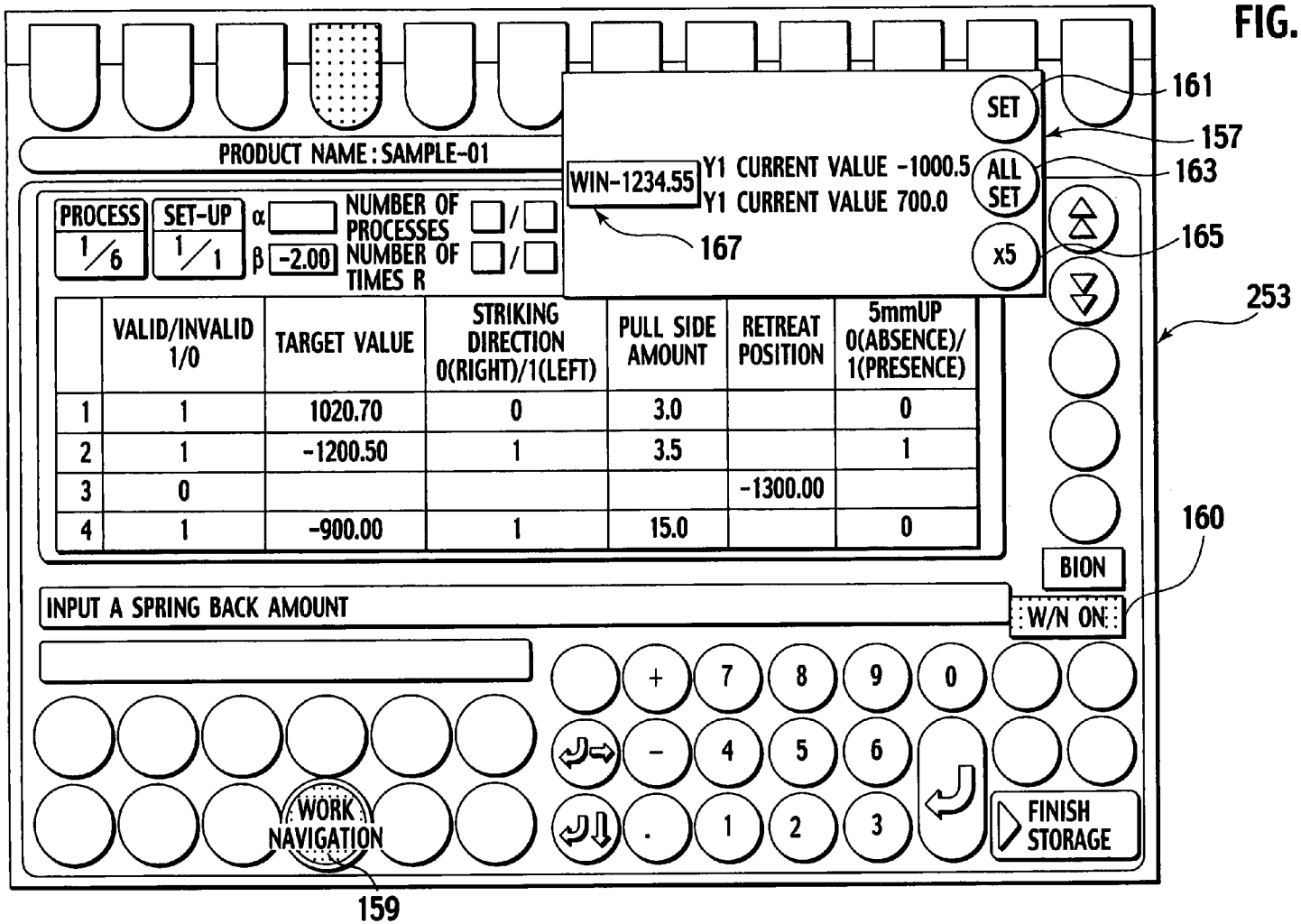

Further, as shown in FIG. 19B, an experienced operator, on the basis of his/her own judgment, instructs "Valid/Invalid" of work navigating function according to each bending order 1 to 4 displayed as 1 to 4 in a left-end column of a table shown below the window 157 to set a target position of positioning of the work navigating function. Subsequently, which of a left and right side faces of the work navigating striking member the end face or end side of the work strikes against, to what extent each pull side amount (avoidance transfer amount) is, whether or not the work navigating member is raised higher than a normal work navigating position by 5 mm, and the like are set arbitrarily and the setting values is stored in the storage part 37. Thus, in the case of a repeated product, suitable processing can apply to the product by calling the above-mentioned values in the processing from the storage part 37.

Next, an embodiment of positioning the work and mold in the horizontal direction by using the back gauge will be described with reference to FIG. 20 and FIG. 22. Since the NC device 95 in the bending machine in accordance with the third embodiment of the present invention can be used as an NC device, detailed description of consideration of the NC device is not repeated.

Figure 20:
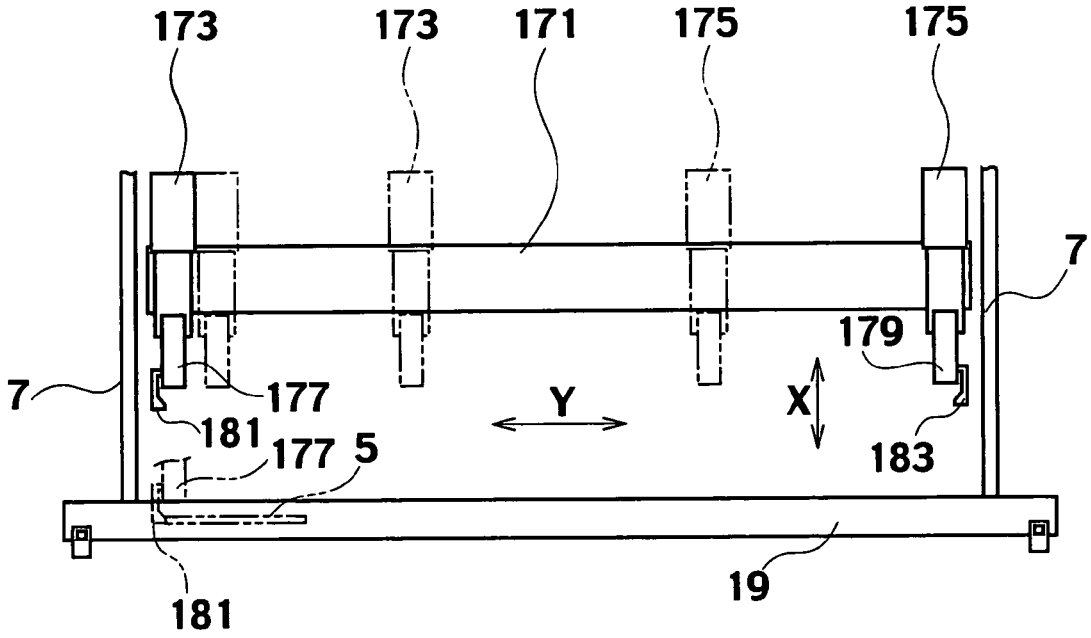
FIG. 20 is a view for illustrating an operation of navigating a tool by a back gauge of the bending machine in accordance with the embodiment of the present invention.
Figure 21:
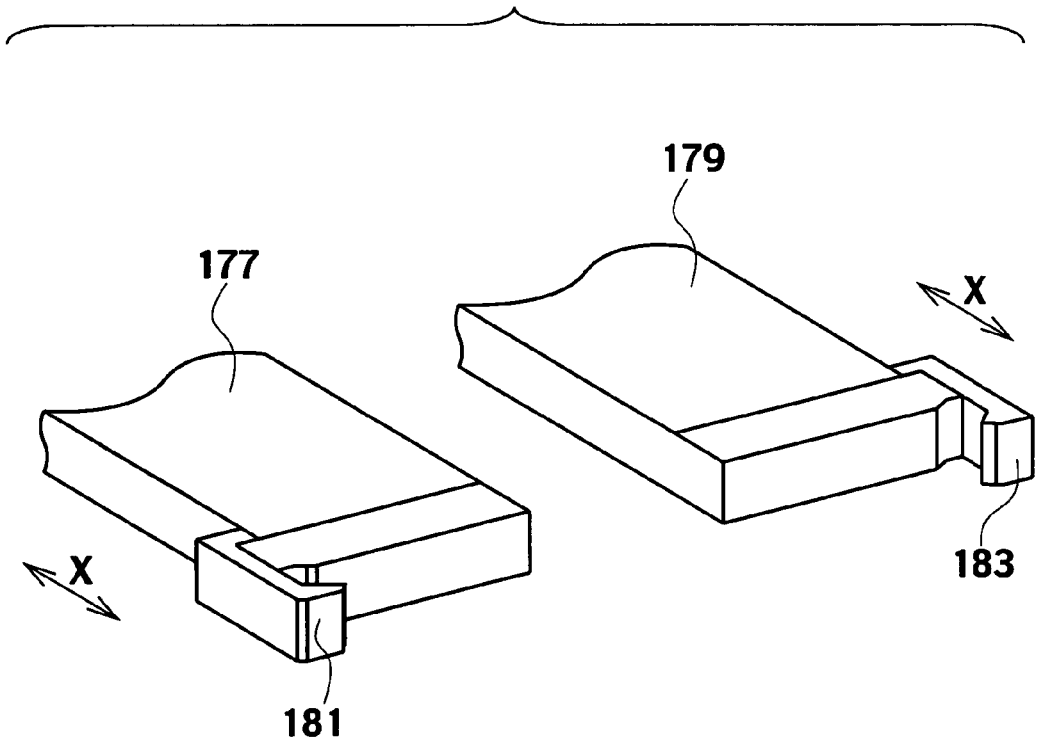
FIG. 21 is a view for illustrating an operation of the back gauge of the bending machine in accordance with the embodiment of the present invention.

As shown in FIG. 20, back gauges 173, 175 are provided to be movable in the Y-axis direction to a carriage 171 that can be freely move in the X-axis direction. Striking members 177, 179 are provided at front end parts of the back gauges 173, 175, respectively. Further, as shown in FIG. 21, locating members 181, 183 capable of moving in the X-axis direction are each provided at the corresponding striking members 177, 179.

With the above-mentioned configuration, the striking member 177 is moved to the position represented by a chain double-dashed line. Subsequently, the operator slides the lower bending mold 5 in the Y-axis direction to be struck against the striking member 177. Whereby, the lower bending mold 5 can be positioned at a predetermined position in the Y-axis direction.

Figure 22B:
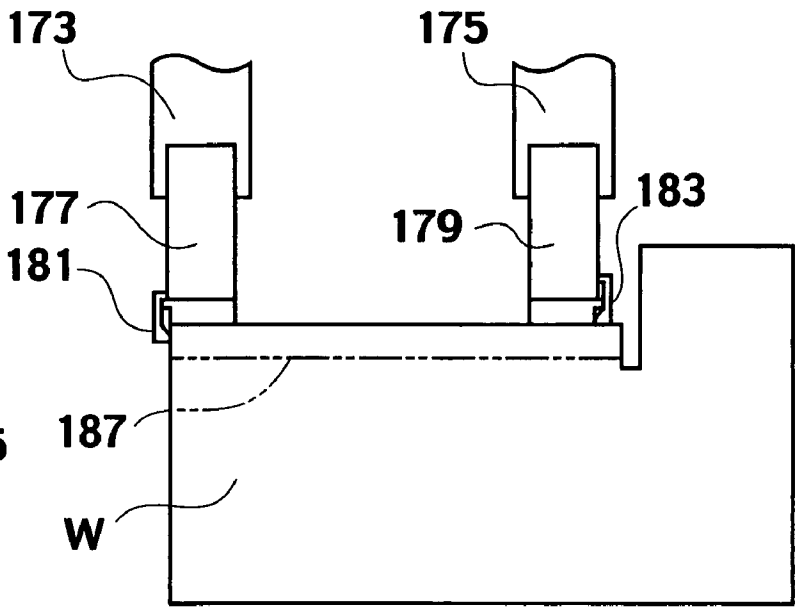
FIGS. 22A and B are views illustrating an operation of navigating the tool by the back gauge of the bending machine in accordance with the embodiment of the present invention.
Figure 22A:
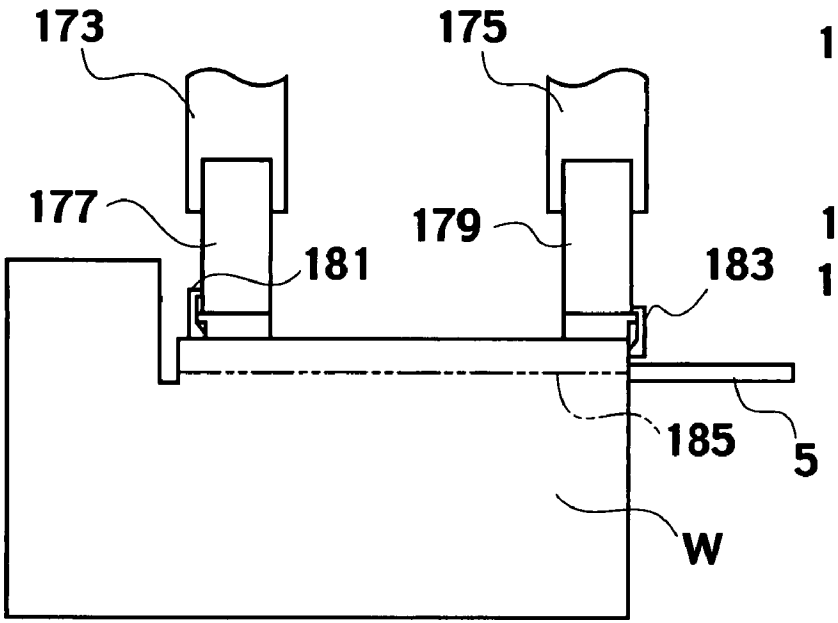

Next, as mentioned above, when the lower bending mold 5 is positioned and fixed, as shown in FIG. 22, it is necessary to transfer and halt the workpiece W to a predetermined bending position. In the state shown in FIG. 22A, to perform bending at the position of a bending line 185, the bending line 185 requires matching with the bending position of the lower bending mold 5. In this case, positioning in the X-axis direction is performed by striking the workpiece W against the striking members 177, 179 and positioning in the Y-axis direction is performed by striking the workpiece W against the locating member 183. In this case, the other locating member 181 is retreated as shown in FIG. 22A.

When bending is performed in the direction opposite to the above-described direction, positioning in the X-axis direction is performed by striking the workpiece W against the striking members 177, 179 similarly to the case above, while positioning in the Y-axis direction is performed by striking the workpiece W against the locating member 181. In this case, the other locating member 183 is retreated as shown in FIG. 22B.

With this configuration, since the back gauges 173, 175 enables positioning of the workpiece W as well as the lower bending mold 5, the device can be simplified. In this embodiment, the traveling servo motor control part 97 shown in FIG. 13 is modified to be triaxial and three traveling servo motors 79 are provided. As a result, movement of the carriage 171 in the X-axis direction and movement of each of the back gauges 173, 175 in the Y-axis direction, that is, movement in the three-axis directions in total, are controlled.

Figure 23:
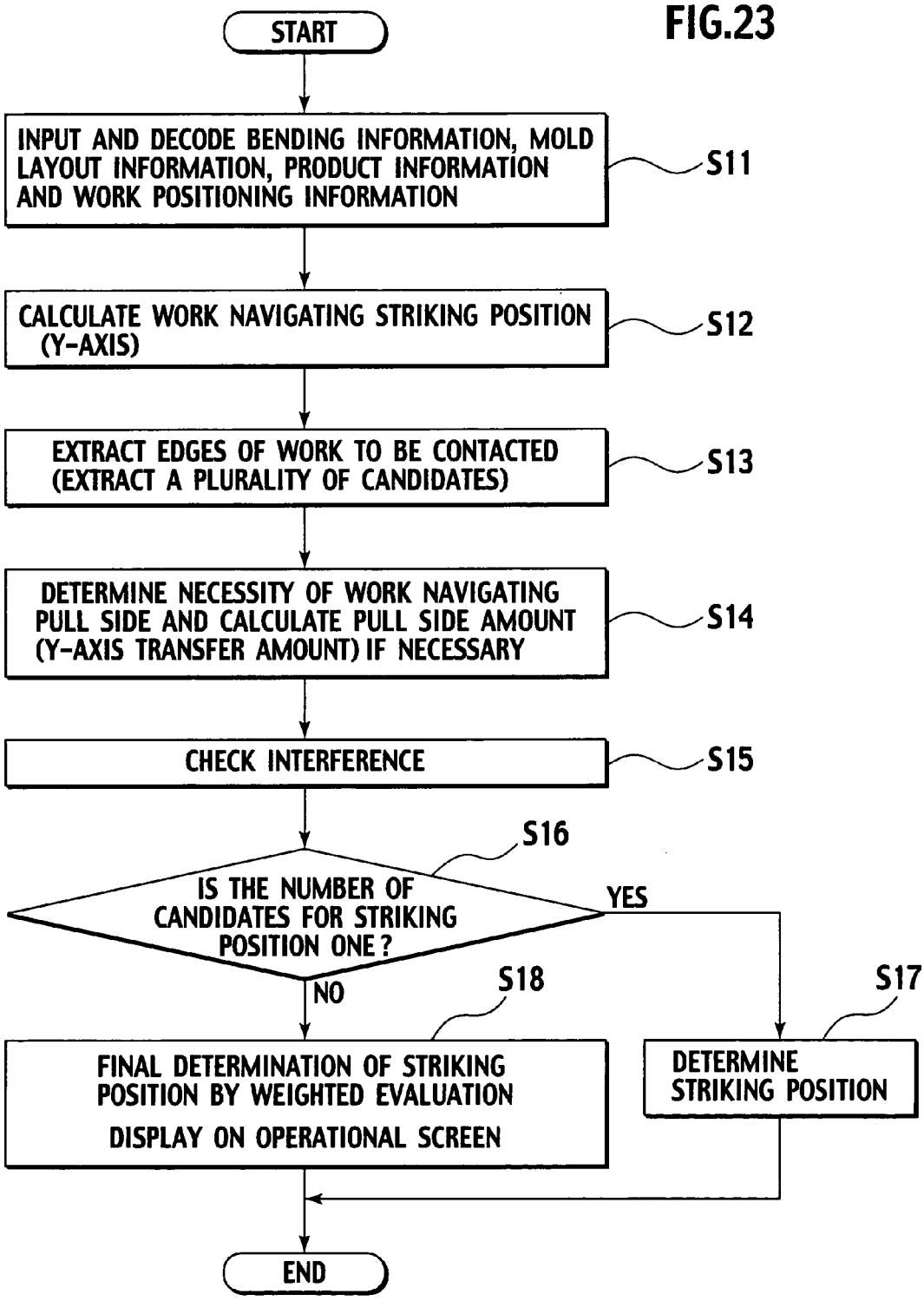
FIG. 23 is a view showing a flow of an operation of detaching the locating member from the mold to avoid interference of the workpiece with the mold during bending.

Further, as another embodiment, an embodiment in which the locating member 145 is moved so as to avoid interference with the workpiece W will be described with reference to FIG. 13 and FIG. 23.

Firstly, the bending information, the mold layout information, the product information and the work positioning information are input (S11) and in the CPU 33, a position in the Y-axis direction that satisfies the predetermined appropriate positional relationship of the workpiece W with respect to the lower bending mold (work navigating striking position) is calculated (S12).

Then, in the state where the workpiece W and the lower bending mold 5 exist at the above-mentioned work navigating striking position, a plurality of edges of the workpiece W to be contacted with the locating member 145 are extracted (S13).

Next, whether or not the locating member 145 needs to be departed (pull side) from the work in the Y-axis direction at each of the extracted plural work navigating striking positions and the transfer amount of departing the locating member 145 from the work in the Y-axis direction are calculated in the CPU 33 shown in FIG. 13 (S14).

Further, when the locating member 145 is departed from the work in the Y-axis direction, whether or not the locating member 145 interferes with the work in the CPU 33 (S15).

Next, whether the number of candidates for the work navigating striking positions is one or two or more is determined (S16) and in the case where the number of candidates for the work navigating striking positions is one, the candidate is determined as the work navigating striking position (S17).

On the other hand, when it is determined that the number of candidates of the work navigating striking positions is two or more in the step 16, weighted evaluation of the most appropriate candidate among the candidates for the work navigating striking positions is calculated to determine the most appropriate work navigating striking position and the position is displayed on the display device 253 of the CPU 33 (FIG. 19) and informed to the operator (S18).

Thus, the operator can easily recognize which side of the plural sides of the work should be struck against what place of the work navigating striking member (left side face or right side face) and therefore, positioning of the work in the horizontal direction can be performed properly.

Subsequently, the operator allows the work to strike against the locating member 145 in the Y-axis direction according to the work navigating striking position thus determined. Whereby, the work can be positioned with respect to the lower bending mold 5 in the Y-axis direction.

The present invention is not limited to the above-mentioned embodiments of the present invention and can be available in other various modes by making necessary modifications.

Especially, a work following device exists as a device generally annexed to the bending machine. Since both ends of the work rotate upwards making the mold as a boundary when the work is bent, a hand of a robot also follows upwards while holding the work. Like the above-mentioned back gauge, this work following device can move to a predetermined position both in the Y-axis direction and in the X-axis direction. Therefore, by providing the locating member (navigating pin) at the hand of the robot, effects similar to those in the second to fourth embodiments can be achieved.

All contents in Japanese Patent Application No. 2002-308988 (filed on Oct. 23, 2002) and Japanese Patent Application No. 2003-357269 (filed on Oct. 17, 2003) is incorporated into the present description by reference.

The invention claimed is:

1. A bending machine for bending a workpiece by cooperation of an upper bending mold and a lower bending mold which are relatively movable in a vertical direction, comprising:

an upper table which has an upper mold attachment part which attaches the upper bending mold on a bottom side thereof and extends in a horizontal direction;

a lower table which is opposed to the upper table in the vertical direction, has a lower mold attachment part which attaches the lower bending mold on a top side thereof and extends in the horizontal direction;

an input part which inputs product information;

a bending order determiner that determines a bending order of the workpiece;

a mold determiner that determines a mold necessary for bending the workpiece;

a layout determiner that determines a layout of the mold;

a positioning information calculator that calculates a position of the workpiece with respect to the mold determined by the layout determiner as work position information; and a navigating member which navigates a position of the workpiece to a operator by movement in the horizontal direction on the basis of the work position information calculated by the positioning information calculator.

2. The bending machine according to claim 1, wherein the navigating member is provided on a front face of the lower table so as to be movable in the horizontal direction, has a striking face to which an end face of the workpiece can strike from the left or right direction; and the navigating member can be freely moved in the direction of an upper face of a die after positioning in the horizontal direction.

3. The bending machine according to claim 2, wherein a locating member is provided at a front end of the navigating member and has a mounting table which maintains a height of the workpiece appropriately when the workpiece is struck against an end face of the locating member.

4. The bending machine according to claim 2, wherein a locating member is rotatably mounted at the front end of the navigating member and by rotating the locating member and striking the workpiece against the end face of the locating member, position of the mold can be guided to the operator.

5. The bending machine according to claim 1, wherein the navigating member is a back gauge provided in the rear side of the lower table so as to be movable in the horizontal direction and a longitudinal direction.

6. The bending machine according to claim 1, wherein the navigating member is a light-emitting device which guides the position of the workpiece to the operator by emitting light at an appropriate position.

7. The bending machine according to claim 1, wherein the navigating member is a belt with a navigating guide part and the navigating guide part stops at an appropriate position, thereby to guide the position of the workpiece to the operator.

8. A bending machine for bending a workpiece by cooperation of an upper bending mold and a lower bending mold, comprising:

an upper table which has an upper mold attachment part which attaches the upper bending mold on a bottom side thereof and extends in a horizontal direction;

a lower table which is formed so as to be opposed to the upper table in a vertical direction, has a lower mold attachment part which attaches the lower bending mold on a top side thereof, extends in the horizontal direction and is movable in the vertical direction with respect to the upper table;

a navigating member which is provided on a front face of at least either of the upper table or the lower table so as to be movable in the horizontal direction and guides an operator;

a traveling actuator which transfers the navigating member in the horizontal direction;

a mold layout determiner that determines mold layout information representing a layout mode of the lower bending mold and the upper bending mold in the horizontal direction on the basis of product information representing at least a shape of a product;

a positioning information calculator which calculates work positioning information representing a positioning mode of the workpiece with respect to the lower bending mold on the basis of the product information and the mold layout information; and a traveling actuator controller which controls the traveling actuator so as to locate the navigating member at a position corresponding to a work positioning reference position in the horizontal direction on the basis of the mold layout information.

9. The bending machine according to claim 8, wherein the navigating member is provided on a front face of the lower table so as to be movable in the horizontal direction, has a striking face to which an end face of the workpiece can strike from the left or right direction; and the navigating member can be freely moved in the direction of an upper face of a die after positioning in the horizontal direction.

* * * * *